US009322239B2

(12) United States Patent
Angeles Boza et al.

(10) Patent No.: US 9,322,239 B2
(45) Date of Patent: Apr. 26, 2016

(54) DRAG ENHANCING STRUCTURES FOR DOWNHOLE OPERATIONS, AND SYSTEMS AND METHODS INCLUDING THE SAME

(71) Applicants: Renzo M. Angeles Boza, Houston, TX (US); Randy C. Tolman, Spring, TX (US); Abdel Wadood M. El-Rabaa, Plano, TX (US); Christian S. Mayer, Pearland, TX (US); Pavlin B. Entchev, Moscow (RU); Jonathan L. Hollett, Calgary (CA)

(72) Inventors: Renzo M. Angeles Boza, Houston, TX (US); Randy C. Tolman, Spring, TX (US); Abdel Wadood M. El-Rabaa, Plano, TX (US); Christian S. Mayer, Pearland, TX (US); Pavlin B. Entchev, Moscow (RU); Jonathan L. Hollett, Calgary (CA)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 14/428,225

(22) PCT Filed: Sep. 13, 2013

(86) PCT No.: PCT/US2013/059738

§ 371 (c)(1),
(2) Date: Mar. 13, 2015

(87) PCT Pub. No.: WO2014/077948

PCT Pub. Date: May 22, 2014

(65) Prior Publication Data

US 2015/0247372 A1 Sep. 3, 2015

Related U.S. Application Data

(60) Provisional application No. 61/725,899, filed on Nov. 13, 2012.

(51) Int. Cl.
*E21B 23/08* (2006.01)
*E21B 29/02* (2006.01)
(Continued)

(52) U.S. Cl.
CPC ..... *E21B 33/12* (2013.01); *E21B 23/10* (2013.01); *E21B 23/14* (2013.01); *E21B 43/116* (2013.01); *E21B 43/14* (2013.01); *E21B 43/25* (2013.01)

(58) Field of Classification Search
CPC ..... E21B 23/03; E21B 23/08; E21B 23/14; E21B 29/02
USPC ..... 166/381, 383, 385, 376
See application file for complete search history.

(56) References Cited

U.S. PATENT DOCUMENTS 3,467,196 A * 9/1969 Kinsman ..... E21B 23/08 166/115
3,525,401 A * 8/1970 Childers ..... B08B 9/0436 166/153

(Continued)

FOREIGN PATENT DOCUMENTS

WO 2011/150251 A1 12/2011

*Primary Examiner* — Kenneth L Thompson
(74) *Attorney, Agent, or Firm* — ExxonMobil Upstream Research-Law Department

(57) ABSTRACT

Drag-enhancing structures for downhole operations are included in a downhole assembly that further includes a tool string, extends past a maximum transverse perimeter of the tool string, and increases resistance to fluid flow past the downhole assembly when the downhole assembly is pumped in a downhole direction within a wellbore conduit. The systems and methods include conveying the downhole assembly in the downhole direction within the wellbore conduit. The systems and methods further may include decreasing the resistance to fluid flow past the downhole assembly after the downhole assembly is located within a target region of the wellbore conduit and/or flowing a sealing material past the downhole assembly while the downhole assembly is located within the wellbore conduit.

31 Claims, 9 Drawing Sheets

(51) Int. Cl.

| | |
|---|---|
| ***E21B 33/12*** | (2006.01) |
| ***E21B 23/10*** | (2006.01) |
| ***E21B 23/14*** | (2006.01) |
| ***E21B 43/116*** | (2006.01) |
| ***E21B 43/14*** | (2006.01) |
| ***E21B 43/25*** | (2006.01) |

(56) References Cited

U.S. PATENT DOCUMENTS

| | | | | |
|---|---|---|---|---|
| 3,595,314 | A | 7/1971 | Garner | |
| 4,187,909 | A | 2/1980 | Erbstoesser | |
| 4,194,561 | A | 3/1980 | Stokley et al. | |
| 4,402,551 | A * | 9/1983 | Wood | E21B 7/061 166/117.5 |
| 5,131,472 | A | 7/1992 | Dees | |
| 5,163,515 | A * | 11/1992 | Tailby | E21B 23/08 166/116 |
| 5,209,304 | A * | 5/1993 | Nice | E21B 23/10 166/154 |
| 5,429,194 | A * | 7/1995 | Nice | E21B 33/068 166/383 |
| 5,497,807 | A * | 3/1996 | Rogers | F16L 55/1645 138/97 |
| 5,507,345 | A | 4/1996 | Wehunt, Jr. et al. | |
| 5,871,052 | A | 2/1999 | Benson et al. | |
| 5,894,888 | A | 4/1999 | Wiemers et al. | |
| 5,909,774 | A | 6/1999 | Griffith et al. | |
| 6,056,055 | A | 5/2000 | Falconer et al. | |
| 6,095,245 | A | 8/2000 | Mount | |
| 6,343,412 | B1 * | 2/2002 | Stephenson | F16L 55/128 138/98 |
| 6,378,627 | B1 | 4/2002 | Tubel et al. | |
| 6,394,184 | B2 | 5/2002 | Tolman et al. | |
| 6,497,284 | B2 | 12/2002 | van Petegem et al. | |
| 6,513,599 | B1 | 2/2003 | Bixenman et al. | |
| 6,520,255 | B2 | 2/2003 | Tolman et al. | |
| 6,543,538 | B2 | 4/2003 | Tolman et al. | |
| 6,575,247 | B2 | 6/2003 | Tolman et al. | |
| 6,581,689 | B2 | 6/2003 | Hailey, Jr. | |
| 6,601,646 | B2 | 8/2003 | Streich et al. | |
| 6,672,405 | B2 | 1/2004 | Tolman et al. | |
| 6,679,341 | B2 | 1/2004 | Bloom et al. | |
| 6,752,206 | B2 | 6/2004 | Watson et al. | |
| 6,789,623 | B2 | 9/2004 | Hill, Jr. et al. | |
| 6,817,410 | B2 | 11/2004 | Wetzel et al. | |
| 6,830,104 | B2 | 12/2004 | Nguyen et al. | |
| 6,843,317 | B2 | 1/2005 | Mackenzie | |
| 6,915,856 | B2 | 7/2005 | Gentry et al. | |
| 6,935,432 | B2 | 8/2005 | Nguyen | |
| 6,957,701 | B2 | 10/2005 | Tolman et al. | |
| 6,983,796 | B2 | 1/2006 | Bayne et al. | |
| 6,997,263 | B2 | 2/2006 | Campbell et al. | |
| 7,044,226 | B2 * | 5/2006 | Stave | B08B 9/032 134/22.12 |
| 7,055,598 | B2 | 6/2006 | Ross et al. | |
| 7,059,407 | B2 | 6/2006 | Tolman et al. | |
| 7,096,945 | B2 | 8/2006 | Richards et al. | |
| 7,100,691 | B2 | 9/2006 | Nguyen et al. | |
| 7,172,038 | B2 | 2/2007 | Terry et al. | |
| 7,252,142 | B2 | 8/2007 | Brezinski et al. | |
| 7,264,061 | B2 | 9/2007 | Dybevik et al. | |
| 7,322,421 | B2 * | 1/2008 | Blacklaw | E21B 23/08 166/383 |
| 7,325,616 | B2 | 2/2008 | Lopez de Cardenas et al. | |
| 7,353,871 | B2 | 4/2008 | Hromas et al. | |
| 7,357,151 | B2 | 4/2008 | Lonnes | |
| 7,363,967 | B2 | 4/2008 | Burris, II et al. | |
| 7,367,395 | B2 | 5/2008 | Vidrine et al. | |
| 7,385,523 | B2 | 6/2008 | Thomeer et al. | |
| 7,407,007 | B2 | 8/2008 | Tibbles | |
| 7,431,085 | B2 | 10/2008 | Coronado et al. | |
| 7,431,098 | B2 | 10/2008 | Ohmer et al. | |
| 7,441,605 | B2 | 10/2008 | Coronado et al. | |
| 7,467,778 | B2 | 12/2008 | Lonnes | |
| 7,516,792 | B2 | 4/2009 | Lonnes et al. | |
| 7,562,709 | B2 | 7/2009 | Saebi et al. | |
| 7,591,321 | B2 | 9/2009 | Whitsitt et al. | |
| 7,703,507 | B2 | 4/2010 | Strickland | |
| 7,735,559 | B2 | 6/2010 | Malone | |
| 7,814,970 | B2 | 10/2010 | Strickland | |
| 8,029,026 | B2 | 10/2011 | Stolle et al. | |
| 8,037,934 | B2 | 10/2011 | Strickland | |
| 8,162,051 | B2 | 4/2012 | Strickland | |
| 8,272,439 | B2 | 9/2012 | Strickland | |
| 8,353,348 | B2 * | 1/2013 | Chitwood | E21B 4/04 166/302 |
| 9,097,084 | B2 * | 8/2015 | McDougall | E21B 23/08 |
| 2002/0093431 | A1 | 7/2002 | Zierolf | |
| 2004/0007829 | A1 | 1/2004 | Ross | |
| 2004/0221993 | A1 | 11/2004 | Patterson et al. | |
| 2005/0241824 | A1 | 11/2005 | Burris et al. | |
| 2005/0263287 | A1 | 12/2005 | Achee, Jr. et al. | |
| 2007/0056750 | A1 | 3/2007 | John et al. | |
| 2008/0053658 | A1 | 3/2008 | Wesson et al. | |
| 2008/0125335 | A1 | 5/2008 | Bhavsar | |
| 2008/0142222 | A1 | 6/2008 | Howard et al. | |
| 2008/0196896 | A1 | 8/2008 | Bustos et al. | |
| 2008/0257546 | A1 | 10/2008 | Cresswell et al. | |
| 2009/0084556 | A1 | 4/2009 | Richards et al. | |
| 2009/0114385 | A1 | 5/2009 | Lumbye | |
| 2009/0114392 | A1 | 5/2009 | Tolman et al. | |
| 2009/0120637 | A1 | 5/2009 | Kirkwood et al. | |
| 2009/0159279 | A1 | 6/2009 | Assal | |
| 2009/0248307 | A1 | 10/2009 | Barrow et al. | |
| 2009/0283279 | A1 | 11/2009 | Patel et al. | |
| 2009/0301723 | A1 | 12/2009 | Gray | |
| 2010/0051278 | A1 | 3/2010 | Mytopher et al. | |
| 2010/0122813 | A1 | 5/2010 | Trummer et al. | |
| 2010/0200230 | A1 | 8/2010 | East, Jr. et al. | |
| 2011/0035152 | A1 | 2/2011 | Surocher et al. | |
| 2011/0048122 | A1 | 3/2011 | Le Foll et al. | |
| 2013/0062055 | A1 | 3/2013 | Tolman et al. | |

* cited by examiner

DRAG ENHANCING STRUCTURES FOR DOWNHOLE OPERATIONS, AND SYSTEMS AND METHODS INCLUDING THE SAME

CROSS REFERENCE TO RELATED APPLICATIONS

This application is the National Stage entry under 35 U.S.C. 371 of PCT/US2013/059738 that published as WO 2014/077948 and was filed on 13 Sep. 2013, which claims the benefit of U.S. Provisional Application No. 61/725,899, filed on Nov. 13, 2012, the disclosure of which is hereby incorporated by reference.

FIELD OF THE DISCLOSURE

The present disclosure is directed generally to drag-enhancing structures for wellbore operations, and more specifically to systems and methods that utilize drag-enhancing structures to improve pump-down of downhole assemblies and/or stimulation operations subsequent to the pump-down.

BACKGROUND OF THE DISCLOSURE

Many downhole operations that are performed during the life of a well, such as during drilling, completing, stimulating, and/or producing, may utilize a downhole assembly that may be conveyed from a surface region to a desired, or target, region, or zone, of a wellbore conduit that forms a portion of the well. In wells that include a vertical, or at least substantially vertical, wellbore conduit, insertion and/or location of the downhole assembly within the desired region of the wellbore conduit may be accomplished by conveying the downhole assembly into the wellbore conduit under the influence of gravity. However, in wells that include deviated and/or horizontal wellbore conduits, or at least portions that are deviated and/or horizontal, a motive force other than gravity may need to be utilized to convey the downhole assembly to the target region of the wellbore conduit.

This motive force may be provided by inserting the downhole assembly into the wellbore conduit and providing a fluid to a portion of the wellbore conduit that is uphole from the downhole assembly, with the flow of the fluid into the wellbore conduit conveying the downhole assembly toward a terminal end of a wellbore that defines the wellbore conduit. This process may be referred to herein as pumping the downhole assembly into the wellbore, or as a pump-down operation.

During a pump-down operation, drag forces between the fluid that is flowing in the wellbore conduit and the downhole assembly generate a pressure drop across the downhole assembly, which provides the motive force to convey the downhole assembly within the wellbore. In general, a magnitude of this motive force, and thus a rate at which the downhole assembly is pumped into the wellbore, may be governed by a variety of factors, including a flow rate of the fluid and/or a cross-sectional area of the downhole assembly (or any suitable portion thereof) relative to a cross-sectional area of the wellbore conduit. Accordingly, downhole assemblies with a larger cross-sectional area may be conveyed more quickly and/or efficiently for a given fluid flow rate.

Fluid flow rates may be limited by other system components and/or fluid availability. Thus, a plug, or other large-diameter device, may be attached to a terminal end of the downhole assembly in order to provide a large cross-sectional area and efficient pumping down of the downhole assembly. Subsequent to the pump-down operation, the plug may be detached from the downhole assembly and may remain within the wellbore conduit, limiting and/or blocking fluid flow therepast. Typically, this plug must eventually be removed from the wellbore conduit, requiring associated time, equipment, labor, and expense.

Alternatively, an outer diameter of the downhole assembly, or a portion thereof, may be increased. However, increasing the outer diameter of the downhole assembly may limit other operations within the well. As an illustrative, non-exclusive example, and during stimulation and/or completion operations, it may be desirable to flow a sealing material, such as ball sealers, from the surface region, past the downhole assembly, and to a perforation that may be present in a wall of a conduit body that defines the wellbore conduit. The ability to flow such a sealing material past the downhole assembly may be limited by the outer diameter of the downhole assembly, thereby limiting a maximum outer diameter thereof. As another illustrative, non-exclusive example, and also during stimulation and/or completion operations, it may be desirable to flow the fluid, such as a fracturing fluid and/or a fluid that includes a proppant material, within the wellbore conduit and past the downhole assembly at a high flow rate, and the outer diameter of the downhole assembly may limit the flow rate that may be provided therepast. Thus, there exists a need for improved drag-enhancing structures that may be utilized during pump-down operations, as well as for systems and methods that include the improved drag-enhancing structures.

SUMMARY OF THE DISCLOSURE

Drag-enhancing structures for downhole operations, and downhole operation systems and methods that include drag-enhancing structures. The drag-enhancing structures may be included in a downhole assembly that further includes a tool string, may extend past a maximum transverse perimeter of the tool string, and may increase a resistance to fluid flow past the downhole assembly when the downhole assembly is pumped in a downhole direction within a wellbore conduit. The systems and methods may include conveying the downhole assembly in the downhole direction within the wellbore conduit. The systems and methods further may include decreasing the resistance to fluid flow past the downhole assembly after the downhole assembly is located within a target region of the wellbore conduit and/or flowing a sealing material past the downhole assembly while the downhole assembly is located within the wellbore conduit.

In some embodiments, the downhole assembly further may include a release mechanism that is configured to release the drag-enhancing structure body from the downhole assembly while the downhole assembly is present within the wellbore conduit. In some embodiments, the release mechanism may release the drag-enhancing structure body from the downhole assembly without damage to the drag-enhancing structure body and/or without damage to a remainder of the downhole assembly.

In some embodiments, the drag-enhancing structure may include a frangible drag-enhancing structure body that is configured to be destroyed while the downhole assembly is present within the wellbore conduit, and the release mechanism may be configured to selectively initiate destruction of the drag-enhancing structure body. In some embodiments, the systems and methods may include destroying the frangible drag-enhancing structure body while the downhole assembly is present within the wellbore conduit and/or while the frangible drag-enhancing structure body is coupled or otherwise connected to the tool string.

In some embodiments, the drag-enhancing structure may include one or more protrusions and/or channels that are configured to provide for the flow of the sealing material past the drag-enhancing structure while the drag-enhancing structure is present within the wellbore conduit. In some embodiments, the drag-enhancing structure further may include a cape that surrounds at least a portion of the protrusions.

DETAILED DESCRIPTION AND BEST MODE OF THE DISCLOSURE

FIGS. 1-14 provide illustrative, non-exclusive examples of drag-enhancing structures 200 according to the present disclosure and/or of systems, apparatus, and/or assemblies that may include, be associated with, be operatively attached to, and/or utilize drag-enhancing structures 200 according to the present disclosure. In FIGS. 1-14, like numerals denote like, or similar, structures and/or features; and each of the illustrated structures and/or features may not be discussed in detail herein with reference to each of FIGS. 1-14. Similarly, each structure and/or feature may not be explicitly labeled in each of FIGS. 1-14; and any structure and/or feature that is discussed herein with reference to any one of FIGS. 1-14 may be utilized with any other of FIGS. 1-14 without departing from the scope of the present disclosure.

In general, structures and/or features that are, or are likely to be, included in a given embodiment are indicated in solid lines in FIGS. 1-14, while optional structures are indicated in broken lines. However, a given embodiment is not required to include all structures and/or features that are illustrated in solid lines therein, and any suitable number of such structures and/or features may be omitted from the given embodiment without departing from the scope of the present disclosure.

Figure 1:
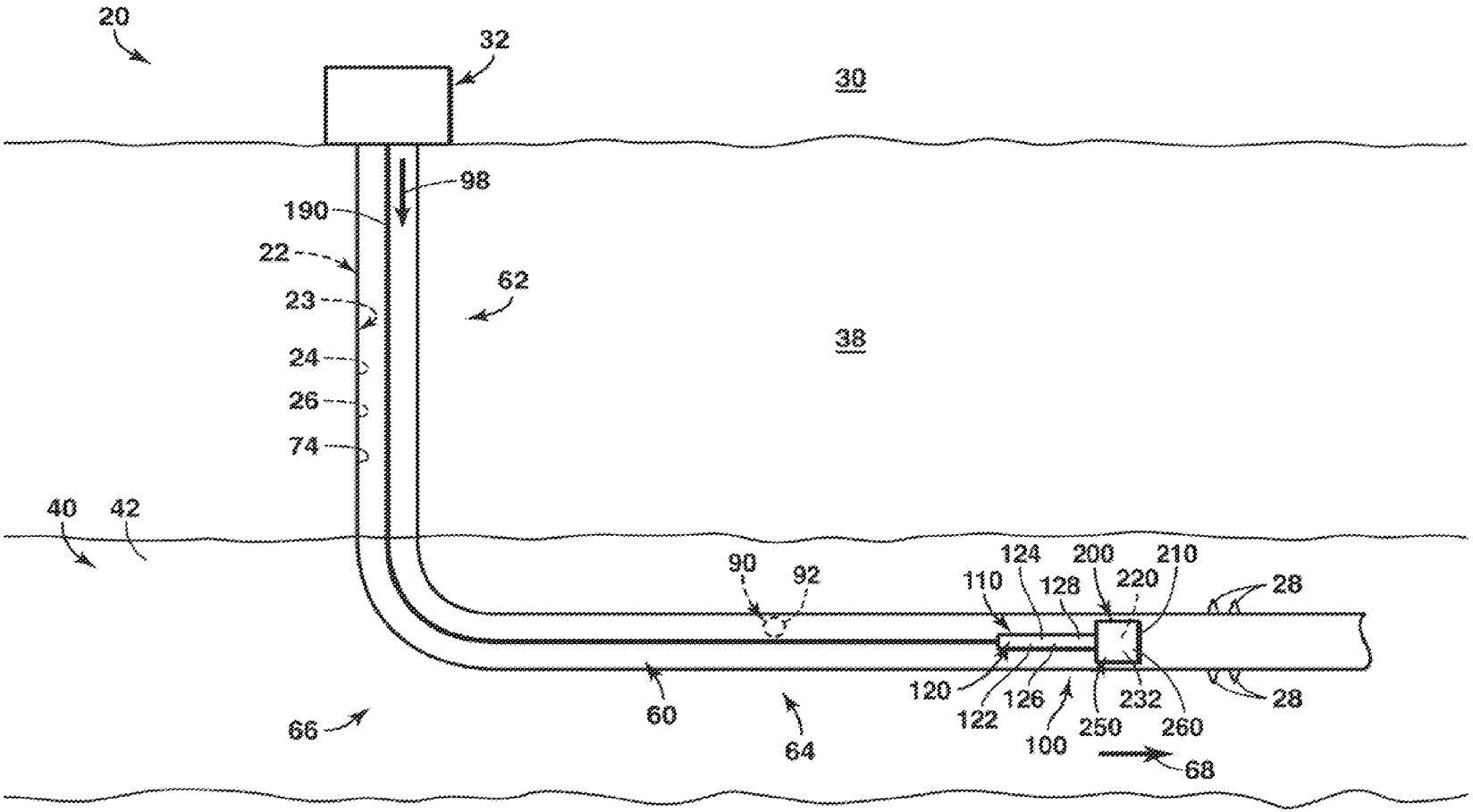
FIG. 1 provides a schematic representation of illustrative, non-exclusive examples of a hydrocarbon well that includes a downhole assembly including a drag-enhancing structure according to the present disclosure.
Figure 2:
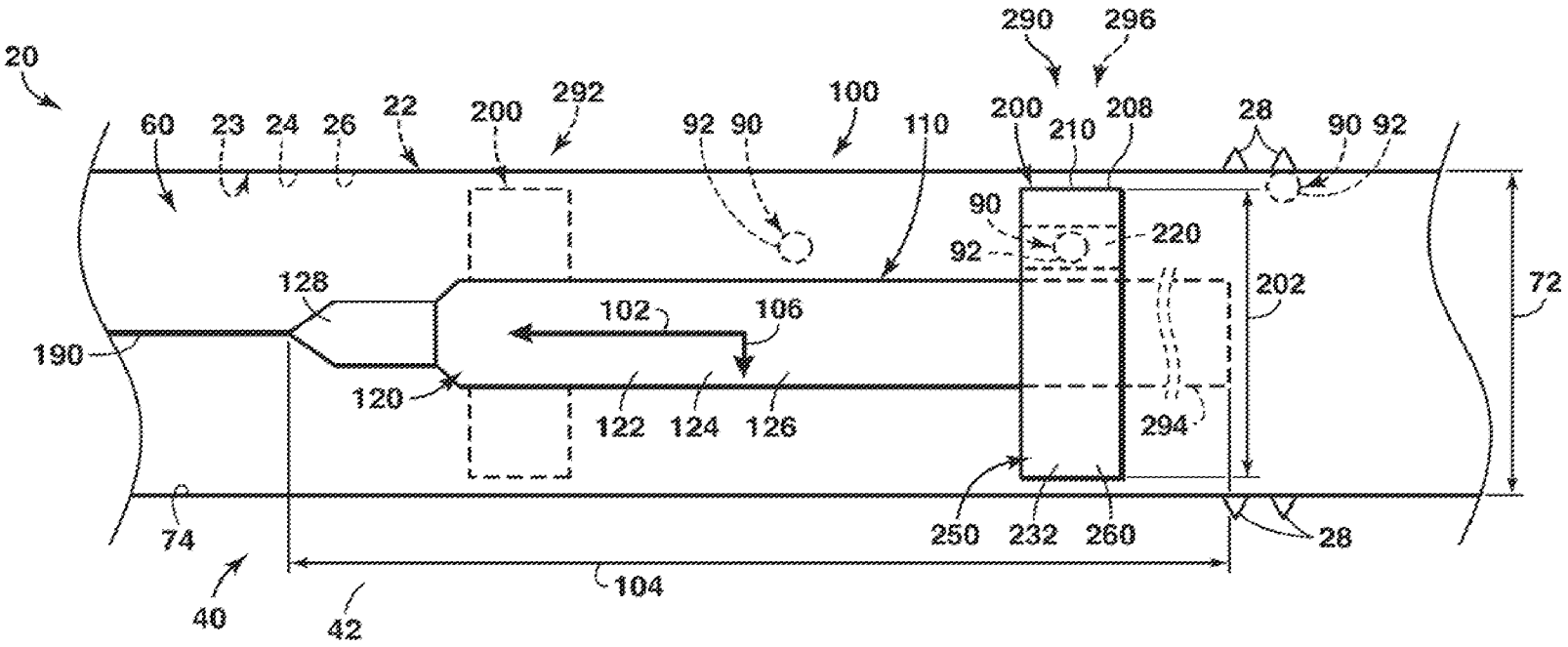
FIG. 2 is a schematic representation of illustrative, non-exclusive examples of a downhole assembly that includes a drag-enhancing structure according to the present disclosure.
Figure 3:
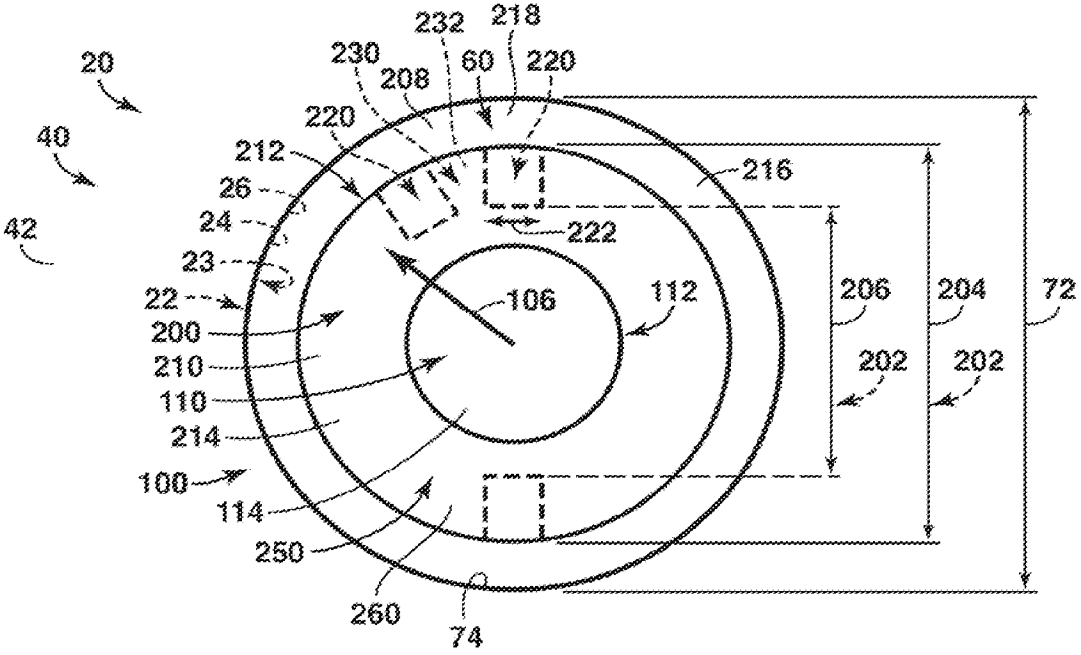
FIG. 3 is a schematic transverse cross-sectional view of the downhole assembly of FIGS. 1-2.
Figure 4:
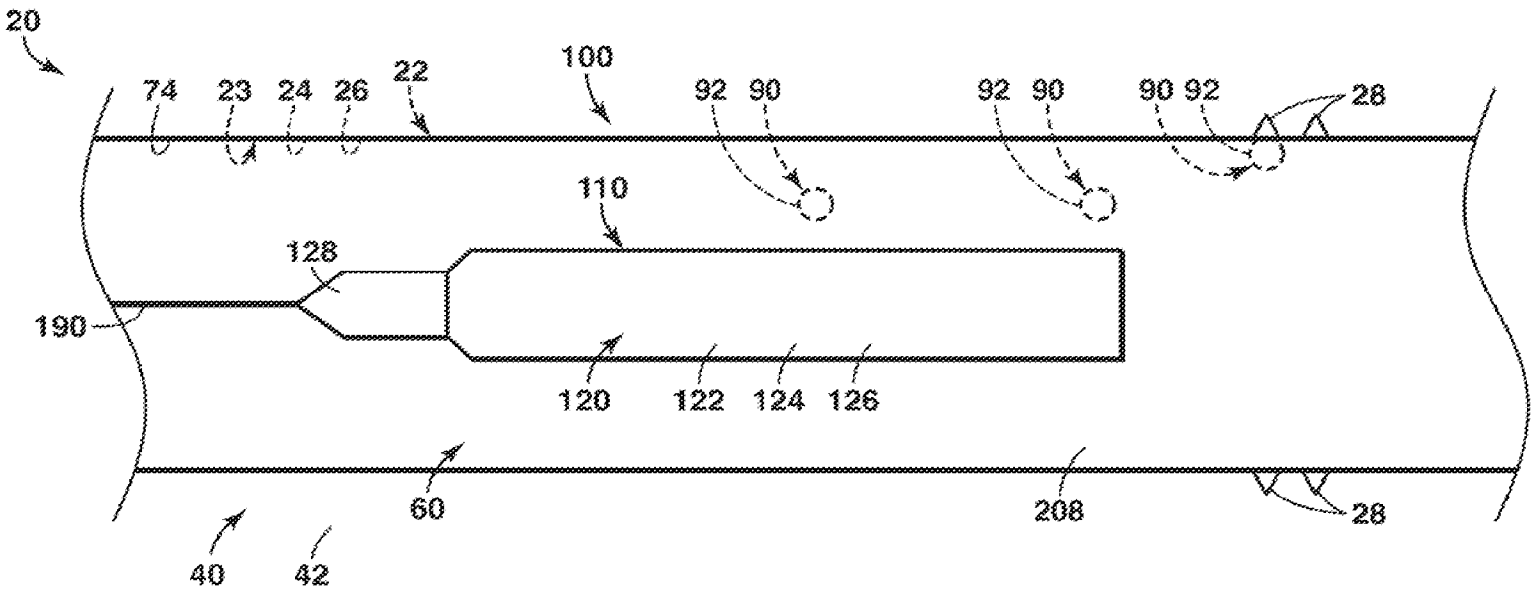
FIG. 4 is a schematic representation of illustrative, non-exclusive examples of a downhole assembly subsequent to removal of a drag-enhancing structure according to the present disclosure.

FIG. 1 provides a schematic representation of illustrative, non-exclusive examples of a hydrocarbon well 20 that includes a wellbore conduit 60. Wellbore conduit 60 contains a downhole assembly 100 including a drag-enhancing structure 200 according to the present disclosure. FIGS. 2-4 provide more detailed but still schematic representations of illustrative, non-exclusive examples of downhole assembly 100 of FIG. 1 within wellbore conduit 60. In FIG. 2, downhole assembly 100 includes drag-enhancing structure 200 attached thereto; and FIG. 3 provides a transverse cross-sectional view of the downhole assembly of FIGS. 1-2. In FIG. 4, downhole assembly 100 does not include drag-enhancing structure 200 operatively attached thereto.

As discussed in more detail herein, drag-enhancing structure 200 may be designed, configured, and/or sized to increase fluid drag across downhole assembly 100 when (i.e., as) downhole assembly 100 is pumped downhole within wellbore conduit 60. This increased fluid drag may increase a rate by which, efficiency by which, and/or total distance over which the downhole assembly may be pumped downhole within the wellbore conduit, as compared to the same downhole assembly 100 that does not include drag-enhancing structure 200.

Subsequent to pumping the downhole assembly downhole within the wellbore conduit, it may be desirable to flow one or more sealing materials 90, such as one or more ball sealers 92, past the downhole assembly to seal one or more perforations 28 in a conduit body 23, such as a casing string 24 and/or a liner 26, that defines wellbore conduit 60. However, and as also discussed in more detail herein, drag-enhancing structure 200 (or at least a maximum transverse dimension 204 (such as illustrated in FIG. 4) thereof) may be sized such that sealing materials 90 may not, or may not readily, flow therepast.

Thus, drag-enhancing structures 200 according to the present disclosure may include one or more structures and/or features that may provide for, or permit, flow of the sealing material therepast. As an illustrative, non-exclusive example, and as discussed in more detail herein with reference to FIGS. 2 and 7-13, drag-enhancing structure 200 may define one or more passages 220 that may provide for, or permit, flow of the sealing material therepast. As another illustrative, non-exclusive example, and as discussed in more detail herein with reference to FIGS. 1-6, drag-enhancing structure 200 may be configured to separate from downhole assembly 100 while the downhole assembly is within wellbore conduit 60, thereby providing for flow of sealing materials 90 past the downhole assembly after separation of drag-enhancing structure 200 therefrom.

As perhaps best illustrated in FIG. 1, hydrocarbon well 20 and/or wellbore conduit 60 thereof may extend between a surface region 30 and a subterranean formation 40 that is present within a subsurface region 38. Subterranean formation 40 may include a reservoir fluid 42, illustrative, non-exclusive examples of which include a hydrocarbon, oil, and/or natural gas.

Wellbore conduit 60 may include any suitable fluid conduit and may be defined by any suitable structure and/or combinations of structures. As an illustrative, non-exclusive example, at least a portion of wellbore conduit 60 may be defined by a wellbore 22. Additionally or alternatively, at least a portion of wellbore conduit 60 may be defined by conduit body 23, casing string 24, and/or liner 26 that extends within wellbore 22.

As illustrated in FIG. 1, wellbore conduit 60 also may have, or extend at, any suitable orientation within subsurface region 38, such as a vertical 62 wellbore conduit 60, a horizontal 64 wellbore conduit 60, and/or a deviated 66 wellbore conduit 60. In addition, wellbore conduit 60 may have and/or define any suitable length. As illustrative, non-exclusive examples, the length of the wellbore conduit may be at least 1000 meters (m), at least 2000 m, at least 3000 m, at least 4000 m, at least 5000 m, at least 6000 m, at least 7000 m, at least 8000 m, at least 9000 m, or at least 10,000 m.

Downhole assembly 100 may include any suitable structure that may be configured to be pumped, or otherwise conveyed, through wellbore conduit 60 in a direction extending generally from surface region 30 to subterranean formation 40. This may include structures that may be located, placed, and/or conveyed within wellbore conduit 60 during construction of, perforation of, completion of, stimulation of, maintenance of, and/or production from well 20.

As illustrated in FIGS. 1-4, downhole assembly 100 may include a tool string 110. In addition, and as illustrated in FIGS. 1-3, downhole assembly 100 at least temporarily includes drag-enhancing structure 200, which may be operatively attached to tool string 110, and may be sized and/or configured to increase a pressure drop across, and/or increase a resistance to fluid flow past, downhole assembly 100 when the downhole assembly is pumped through the wellbore conduit. This may improve a speed and/or an efficiency by which the downhole assembly may be conveyed, moved, and/or flowed within wellbore conduit 60 and/or increase a distance over which the downhole assembly may be conveyed within the wellbore conduit, as compared to a comparable downhole assembly 100 without drag-enhancing structure 200. This may provide for and/or permit more efficient conveyance of the downhole assembly over and/or through a majority of the length of and/or an entire length of the wellbore conduit.

As shown in FIGS. 1-3, drag-enhancing structure 200, which also may be referred to herein as drag enhancer 200, spacer 200, collar 200, and/or drag-enhancing collar 200, may include a drag-enhancing structure body 210 that extends past, or radially outward of, a maximum transverse perimeter 112 (as illustrated in FIG. 3) of tool string 110. This may provide for and/or produce the increased pressure drop across, and/or the increased flow resistance past, downhole assembly 100 when the downhole assembly is pumped in a downhole direction 68 within wellbore conduit 60, such as through supply of a fluid 98 from surface region 30 and/or a wellhead 32 and to, or within, the wellbore conduit (as illustrated in FIG. 1).

As an illustrative, non-exclusive example, and as shown in FIGS. 2-3, downhole assembly 100 may define a longitudinal direction 102, which is parallel to a length 104 of the downhole assembly, and a radial direction 106, which is perpendicular to the longitudinal direction. Furthermore, drag-enhancing structure 200 may extend past at least a portion of tool string 110 in radial direction 106. As discussed in more detail herein, tool string 110 may include a plurality of components and/or may define a plurality of transverse cross-sectional shapes. Thus, and as used herein, the phrase "maximum transverse perimeter of the tool string" refers to an outer perimeter of the tool string, as measured in a plane that is perpendicular to longitudinal direction 102 and at a location of maximum value along length 104 of tool string 110. Similarly, it is within the scope of the present disclosure that a transverse outer perimeter 212 of drag-enhancing structure body 210, as illustrated in FIG. 3, may be measured in a plane that is perpendicular to longitudinal direction 102 and at a location of maximum value along a length of the drag-enhancing structure body.

It is within the scope of the present disclosure that any suitable portion and/or fraction of drag-enhancing structure body 210 may extend outward of the maximum transverse perimeter of the tool string. As an illustrative, non-exclusive example, and as shown in FIG. 3, transverse outer perimeter 212 of drag-enhancing structure body 210 may be greater than and/or may enclose and/or surround at least a portion and/or all of maximum transverse perimeter 112 of the tool string. As another illustrative, non-exclusive example, the transverse outer perimeter of the drag-enhancing structure body may define an included body area 214, the maximum transverse perimeter of the tool string may define an included tool string area 114, and included body area 214 may be greater than included tool string area 114. As illustrative, non-exclusive examples, included body area 214 may be at least 1.1 times, at least 1.2 times, at least 1.3 times, at least 1.4 times, at least 1.5 times, at least 1.75 times, at least 2 times, at least 2.5 times, or at least 3 times greater than included tool string area 114.

As illustrated in FIGS. 2-3, a difference between a transverse dimension 202 of drag-enhancing structure body 210 and a diameter 72 of wellbore conduit 60 may define a clearance 208 between the drag-enhancing structure body and a surface 74 that defines the wellbore conduit, such as an inner surface of wellbore 22, conduit body 23, casing string 24, and/or liner 26. As shown in FIG. 3 and discussed in more detail herein, drag-enhancing structure body 210 may include a circular, or at least substantially circular, transverse cross-sectional shape, and clearance 208 may be defined by a diameter thereof.

However, and as indicated in dashed lines in FIG. 3, drag-enhancing structure body 210 also may include a non-circular transverse cross-sectional shape, such as may be defined by one or more passages 220, which also may be referred to herein as fluid passages 220, ball sealer passages 220, and/or channels 220 that may be present therein and/or by one or more protrusions 230 that may extend therefrom. Thus, drag-enhancing structure body 210 may define a maximum transverse dimension 204, which may be associated with a minimum drag-enhancing structure clearance 216, as well as a minimum transverse dimension 206, which may be associated with a maximum drag-enhancing structure clearance 218.

It is within the scope of the present disclosure that drag-enhancing structure body 210 may be sized such that drag-enhancing structure clearance 208 (when the drag-enhancing structure body includes the circular cross-sectional shape), minimum drag-enhancing structure clearance 216 (when the drag-enhancing structure body includes the non-circular transverse cross-sectional shape), and/or maximum drag-enhancing structure clearance 218 (when the drag-enhancing structure body includes the non-circular transverse cross-sectional shape) may be less than a characteristic dimension of sealing material 90, such as by being less than a diameter of ball sealers 92. Thus, drag-enhancing structure body 210 may limit and/or block flow of sealing material 90 past downhole assembly 100 when the drag-enhancing structure is operatively attached to tool string 110.

As illustrative, non-exclusive examples, drag-enhancing structure clearance 208, minimum drag-enhancing structure clearance 216, and/or maximum drag-enhancing structure clearance 218 may be less than 5 centimeters (cm), less than 4 cm, less than 3 cm, less than 2.5 cm, less than 2 cm, less than 1.5 cm, less than 1.25 cm, less than 1 cm, less than 0.75 cm, or less than 0.5 cm. Additionally or alternatively, drag-enhancing structure clearance 208, minimum drag-enhancing structure clearance 216, and/or maximum drag-enhancing structure clearance 218 may be less than 20%, less than 15%, less than 10%, less than 8%, less than 6%, less than 5%, or less than 4% of wellbore conduit diameter 72.

However, it is also within the scope of the present disclosure that channels 220, when present, may be sized to permit sealing material 90 and/or ball sealers 92 to flow therethrough. Thus, maximum drag-enhancing structure clearance 218 and/or a width 222 of channels 220 may be greater than the diameter of ball sealers 92 and/or may be at least 1.5 cm, at least 1.75 cm, at least 2 cm, at least 2.25 cm, at least 2.5 cm, at least 3 cm, at least 4 cm, or at least 5 cm. Additionally or alternatively, maximum drag-enhancing structure clearance 218 and/or width 222 may be at least 10%, at least 15%, at least 20%, at least 25%, or at least 30% of wellbore conduit diameter 72.

It is within the scope of the present disclosure that drag-enhancing structure 200 may be configured to remain operatively attached to tool string 110 while downhole assembly 100 is within wellbore conduit 60. As illustrative, non-exclusive examples, this may include being operatively attached during pumping/flowing of the tool string in a downhole direction to a desired location/depth in the wellbore conduit, and/or thereafter, such as during subsequent use of the tool string. However, and as illustrated in FIGS. 1-4, it is also within the scope of the present disclosure that at least a portion of drag-enhancing structure 200 may be configured to separate and/or be released from tool string 110 while downhole assembly 100 is within wellbore conduit 60, such as after the tool string is pumped, flowed, or otherwise positioned in a desired, or selected, downhole position or depth. Thus, FIGS. 1-3 illustrate downhole assembly 100 and/or tool string 110 thereof with drag-enhancing structure 200 operatively attached thereto, while FIG. 4 illustrates downhole assembly 100 and/or tool string 110 thereof without drag-enhancing structure 200 operatively attached thereto.

As illustrated in FIGS. 2 and 4, separation of drag-enhancing structure 200 from downhole assembly 100 may increase clearance 208 between downhole assembly 100 and surface 74, thereby providing for flow of sealing materials 90 past the tool string while the tool string is within wellbore conduit 60. It is within the scope of the present disclosure that downhole assembly 100 and wellbore conduit 60 may define a first unoccluded cross-sectional area when the drag-enhancing structure is operatively attached to the tool string and a second unoccluded cross-sectional area when the drag-enhancing structure is not operatively attached to the tool string, with the second unoccluded cross-sectional area being greater than the first unoccluded cross-sectional area. As illustrative, non-exclusive examples, the second unoccluded cross-sectional area may be at least 10%, at least 20%, at least 30%, at least 40%, at least 50%, at least 60%, at least 70%, at least 80%, at least 90%, or at least 100% greater than the first unoccluded cross-sectional area.

When drag-enhancing structure 200 is configured to separate and/or be released from tool string 110 while the downhole assembly is within the wellbore conduit, the drag-enhancing structure may be separated from the tool string in any suitable manner. As an illustrative, non-exclusive example, downhole assembly 100, tool string 110, and/or drag-enhancing structure 200 may include a release mechanism 250 that is configured to separate the drag-enhancing structure from the tool string and/or remove the drag-enhancing structure from the downhole assembly. It is within the scope of the present disclosure that the release mechanism may separate the drag-enhancing structure from the tool string without damage to and/or destruction of the tool string and/or the drag-enhancing structure, such as by releasing an at least substantially intact drag-enhancing structure from the tool string. However, it is also within the scope of the present disclosure that the release mechanism may be configured to selectively initiate destruction of drag-enhancing structure 200 and/or drag-enhancing structure body 210 thereof to separate the drag-enhancing structure from the tool string.

As an illustrative, non-exclusive example, drag-enhancing structure 200 and/or drag-enhancing structure body 210 thereof may include a frangible drag-enhancing structure and/or a frangible drag-enhancing structure body that is configured to be destroyed while the downhole assembly is within the wellbore conduit. This may include a frangible drag-enhancing structure and/or a frangible drag-enhancing structure body that is constructed from any suitable frangible material that is configured to break apart and/or shatter responsive to the action of release mechanism 250.

As used herein, the phrase "frangible material," which also may be referred to herein as "friable material" and/or "destructible material," may include any suitable material that is configured to break apart, fracture, disintegrate, separate, crumble, shatter, and/or crack, such as into small, or even very small, pieces. As an illustrative, non-exclusive example, a frangible or friable material may be broken into particulate and/or granular material. The frangible material may break apart upon application of a fracture stress thereto by release mechanism 250, such as by explosion of an explosive device that is included in the release mechanism. Illustrative, non-exclusive examples of frangible materials according to the present disclosure include brittle materials, plastics, glasses, friable cements, wood, and/or ceramics.

Release mechanism 250 may include any suitable structure that is configured to selectively initiate destruction of at least a portion of drag-enhancing structure 200. As an illustrative, non-exclusive example, release mechanism 250 may include and/or be a perforation charge 122 of a perforation device 120 that forms a portion of tool string 110. As additional illustrative, non-exclusive examples, release mechanism 250 may include and/or be an explosive charge, a primer cord, a mechanical device, and/or a hydraulic device.

It is within the scope of the present disclosure that release mechanism 250 may be actuated in any suitable manner and/or based upon any suitable criteria. As an illustrative, non-exclusive example, the release mechanism may be configured to separate the drag-enhancing structure from the tool string responsive to receipt of a separation signal, which may include and/or be a wireless separation signal and/or an electrical, mechanical, pneumatic, and/or hydraulic separation signal that may be conveyed to the release mechanism by a working line 190 that extends between downhole assembly 100 and wellhead 32 and/or surface region 30. As another illustrative, non-exclusive example, release mechanism 250 may be actuated responsive to downhole assembly 100 being present in and/or reaching a target region of the wellbore conduit.

As yet another illustrative, non-exclusive example, release mechanism 250 may be actuated responsive to downhole assembly 100 becoming stuck and/or otherwise lodged within the wellbore conduit, such as if the downhole assembly becomes stuck while being conveyed into and/or removed from the wellbore conduit. Under these conditions, actuation of release mechanism 250 may separate drag-enhancing structure 200 from tool string 110, decreasing a size of the downhole assembly and permitting continued motion of the downhole assembly within the wellbore conduit.

Regardless of the specific operation of release mechanism 250, it is within the scope of the present disclosure that the release mechanism may be configured to separate the drag-enhancing structure from the tool string without damage to the tool string, without rendering the tool string inoperative, and/or without destruction of the tool string. Thus, tool string 110 may be functional and/or may be utilized to perform one or more operations within wellbore conduit 60 subsequent to separation of the drag-enhancing structure therefrom.

With continued reference to FIGS. 1-4, it is within the scope of the present disclosure that drag-enhancing structure 200 further may include any suitable exterior surface structure, such as a smooth surface, a roughened surface, and/or an undulating surface, that may provide for a target, or desired, resistance to fluid flow therepast. It is also within the scope of the present disclosure that drag-enhancing structure 200 further may include, be associated with, and/or be operatively attached to one or more additional structures that may further define and/or provide the target resistance to fluid flow therepast. As an illustrative, non-exclusive example, and as discussed in more detail herein with reference to FIGS. 12-13, the drag-enhancing structure may include a resilient cape 260. As another illustrative, non-exclusive example, and as discussed in more detail herein with reference to FIG. 14, the drag-enhancing structure may include one or more retractable protrusions 232.

Drag-enhancing structure 200 may be structurally distinct from more traditional plugs, wiper plugs, and/or pigs, which also may be utilized to pump a downhole assembly in a downhole direction within a wellbore conduit. As an illustrative, non-exclusive example, and as discussed in more detail herein, drag-enhancing structure 200 may include passages 220, which may provide for flow of sealing materials 90 therepast while the drag-enhancing structure is operatively attached to the tool string. As another illustrative, non-exclusive example, and when the drag-enhancing structure includes passages 220, the drag-enhancing structure may be configured to, and/or may remain operatively attached to, the tool string throughout an entire time that the tool string is present within wellbore conduit 60.

As yet another illustrative, non-exclusive example, and as discussed in more detail herein, drag-enhancing structure 200 may be configured to be destroyed while downhole assembly 100 is within wellbore conduit 60. This may provide for separation and/or removal of the drag-enhancing structure from tool string 110, thereby providing for flow of sealing materials 90 past the tool string while the tool string is present within the wellbore conduit. However, and in contrast with plugs, wiper plugs, and/or pigs, destruction of drag-enhancing structure 200 may decrease and/or eliminate a need to subsequently remove the drag-enhancing structure from the wellbore conduit and/or decreasing a need for additional structures, such as a landing collar that is configured to receive the plug and/or pig, within the wellbore conduit.

As another illustrative, non-exclusive example, and as also discussed in more detail herein, drag-enhancing structure 200 and surface 74 may define a finite clearance 208, illustrative, non-exclusive examples of which are discussed in more detail herein, therebetween. This finite clearance may be less than the characteristic dimension of sealing materials 90, yet may be significantly greater than a clearance between a plug, wiper plug, and/or pig and surface 74, since the plug, wiper plug, and/or pig may include circumferentially extending wipers that are configured to contact surface 74 around a circumference thereof and/or to fluidly isolate a fluid that is downhole from the plug, wiper plug, and/or pig from a fluid that is uphole from the plug, wiper plug, and/or pig.

Furthermore, and as also discussed in more detail herein, drag-enhancing structures 200 according to the present disclosure may be destroyed through breaking apart and/or shattering a frangible material. In general, frangible materials are rigid materials that resist deformation when a stress that is applied thereto is less than a threshold stress level and then break apart when the applied stress is greater than the threshold stress level. In contrast, plugs, wiper plugs, and/or pigs are constructed from compliant and/or elastomeric materials that readily deform when a stress is applied thereto, thereby providing for the above-discussed fluid isolation despite finite variations in a shape and/or diameter of the wellbore conduit that they may be located within.

As perhaps best illustrated in FIG. 2, drag-enhancing structure 200 may be present on and/or operatively attached to any suitable portion of tool string 110. As an illustrative, non-exclusive example, and as indicated at 290, the drag-enhancing structure may be located at and/or near a downhole end of the tool string. As another illustrative, non-exclusive example, and as indicated at 292, the drag-enhancing structure may be located at and/or near an uphole end of the tool string.

As yet another illustrative, non-exclusive example, and as indicated in dashed lines at 294, at least a portion of the tool string may extend downhole from the drag-enhancing structure. When a portion of the tool string extends downhole from the drag-enhancing structure, the drag-enhancing structure may be referred to as being at a central position, at an intermediate position, and/or at an intermediate location on tool string 110, as indicated at 296. It is within the scope of the present disclosure that tool string 110 may be operatively attached to any suitable number of drag-enhancing structures, such as one, two, three, four, five, or more than five drag-enhancing structures that may be spaced apart from one another along length 104 of the tool string.

With reference to FIGS. 1-4, tool string 110 may include any suitable structure that may be present and/or utilized within wellbore conduit 60. As an illustrative, non-exclusive example, tool string 110 may include and/or be perforation device 120, such as a perforation gun 124, that is configured to create perforations 28. As another illustrative, non-exclusive example, tool string 110 may include a sealing apparatus 126, illustrative, non-exclusive examples of which include a setting tool and a bridge plug. As yet another illustrative, non-exclusive example, the tool string may include a casing collar locator 128.

It is within the scope of the present disclosure that tool string 110 further may include and/or be operatively attached to one or more additional structures that may be utilized within wellbore conduit 60 at any suitable time, such as during construction of, perforation of, completion of, stimulation of, maintenance of, and/or production from well 20. As illustrative, non-exclusive examples, tool string 110 may include any suitable detector, sensor, electronic device, transducer, logging tool, drill string, drill bit, tractor, and/or working line 190.

As discussed in more detail herein, and when the drag-enhancing structure is configured to be separated from the tool string and/or destroyed while the downhole assembly is present within the wellbore conduit, it is within the scope of the present disclosure that the tool string may remain functional subsequent to separation from and/or destruction of the drag-enhancing structure. As an illustrative, non-exclusive example, at least a portion, a substantial portion, a majority, and/or all of the tool string may not be formed from a frangible material. As another illustrative, non-exclusive example, the tool string may be configured to be used within the wellbore conduit subsequent to separation from and/or destruction of the drag-enhancing structure. As yet another illustrative, non-exclusive example, the tool string may be configured to be removed from the wellbore conduit, attached to another drag-enhancing structure, and pumped back into the wellbore conduit and/or another wellbore conduit.

FIGS. 5-14 provide less schematic but still illustrative, non-exclusive examples of drag-enhancing structures 200 according to the present disclosure. The drag-enhancing structures of FIGS. 5-14 may be present within a well 20 and/or a wellbore conduit 60 thereof and may be operatively attached to a tool string 110 to form a downhole assembly 100, as illustrated in more detail in FIGS. 1-4. Moreover, any of the downhole assemblies of any of FIGS. 1-4 may include any of the drag-enhancing structures of any of FIGS. 5-14 without departing from the scope of the present disclosure. In addition, any of the drag-enhancing structures of any of FIGS. 5-14 may be configured to remain attached to the tool string, may be configured to separate from the tool string, and/or may be configured to be destroyed while the tool string is present within the wellbore conduit, as discussed in detail with reference to FIGS. 1-4.

Figure 5:
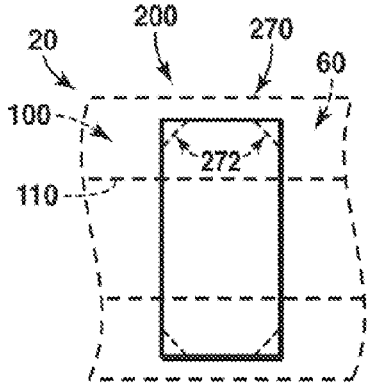
FIG. 5 is a schematic representation of illustrative, non-exclusive examples of a drag-enhancing structure according to the present disclosure.

FIG. 5 is a schematic representation of illustrative, non-exclusive examples of a drag-enhancing structure 200 according to the present disclosure in the form of a cylindrical drag-enhancing structure 270. Cylindrical drag-enhancing structure 270 may include and/or define a circular, or at least substantially circular, transverse cross-sectional shape that may be constant, or at least substantially constant along at least a portion of a length thereof. Additionally or alternatively, and as illustrated in dashed lines in FIG. 5, the cylindrical drag-enhancing structure may include one or more transition regions 272 on an uphole and/or downhole side thereof, such as a tapered region, a chamfered region, and/or a rounded edge, that may decrease a potential for the cylindrical drag-enhancing structure to catch, snag, and/or otherwise become lodged within wellbore conduit 60.

Figure 6:
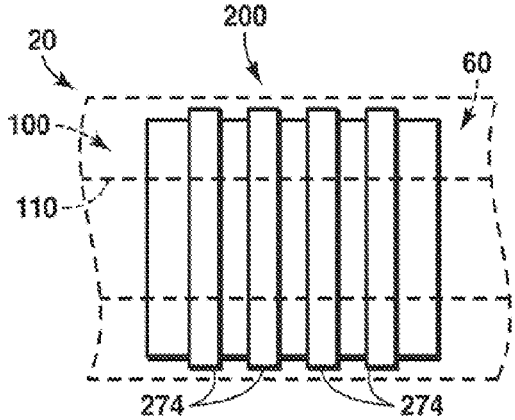
FIG. 6 is a less schematic but still illustrative, non-exclusive example of a drag-enhancing structure according to the present disclosure that includes a plurality of ridges.

FIG. 6 is a less schematic but still illustrative, non-exclusive example of a drag-enhancing structure 200 according to the present disclosure that includes a plurality of circumferentially extending ridges 274 that may be shaped, oriented, and/or otherwise configured to increase the resistance to fluid flow therepast. These circumferentially extending ridges may repeat any suitable number of times, such as at least 2, at least 3, at least 4, at least 5, or at least 6 times, along the length of the drag-enhancing structure, thereby providing the drag-enhancing structure with a transverse cross-sectional shape that is periodic and/or undulates depending upon a location at which the transverse cross-sectional shape is measured.

FIGS. 7-14 provide less schematic but still illustrative, non-exclusive examples of drag-enhancing structures 200 according to the present disclosure that include one or more protrusions 230, such as fins 234, that define a plurality of channels 220. As discussed in more detail herein, channels 220 may be configured and/or sized to provide for flow of fluid, proppant, and/or sealing materials 90 past the drag-enhancing structure while the drag-enhancing structure is present within wellbore conduit 60, as illustrated schematically in FIGS. 8, 10-11, and 13.

Protrusions 230 may be present at any suitable location around a circumference of drag-enhancing structure 200 and may include any suitable shape. As illustrative, non-exclusive examples, protrusions 230 may include and/or be linear fins, tapered fins, arcuate fins, and/or helical fins. In addition, drag-enhancing structure 200 may include any suitable number of protrusions 230, illustrative, non-exclusive examples of which include at least 1, at least 2, at least 3, at least 4, at least 5, at least 6, at least 7, at least 8, or at least 10 protrusions. It is within the scope of the present disclosure that the plurality of protrusions 230 may be at least substantially symmetrical around a circumference of drag-enhancing structure 200. However, it is also within the scope of the present disclosure that protrusions 230 may be asymmetrical around the circumference of the drag-enhancing structure.

Similarly, drag-enhancing structure 200 and/or protrusions 230 thereof may define any suitable number of channels 220 that may include any suitable shape and/or characteristic dimension. As an illustrative, non-exclusive example, channels 220 may be sized to provide for flow of ball sealers 92 therepast. As another illustrative, non-exclusive example, channels 220 may include a width that is greater than a diameter of a ball sealer, greater than 1.5 cm, greater than 1.75 cm, greater than 2 cm, greater than 2.25 cm, greater than 2.5 cm, greater than 3 cm, greater than 4 cm, or greater than 5 cm. As yet another illustrative, non-exclusive example, and similar to protrusions 230, channels 220 may include linear channels, curved channels, arcuate channels, helical channels, and/or tortuous channels.

Figure 7:
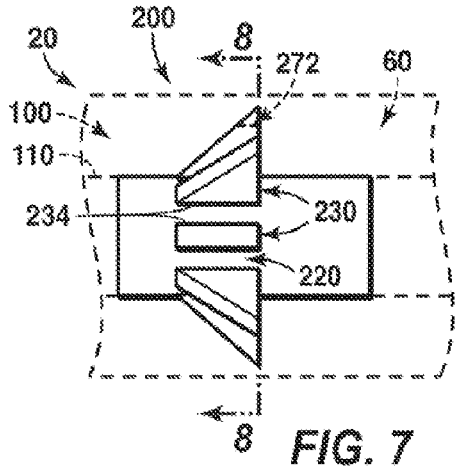
FIG. 7 is another less schematic but still illustrative, non-exclusive example of a drag-enhancing structure according to the present disclosure that includes a plurality of fins.
Figure 8:
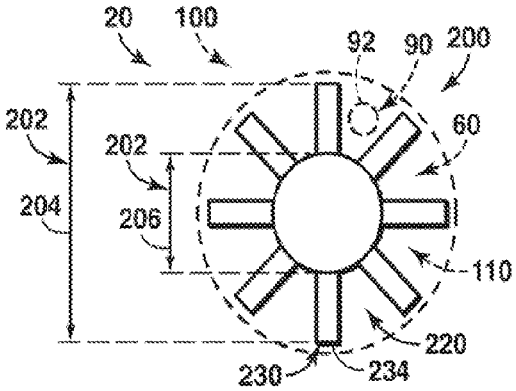
FIG. 8 is a transverse cross-sectional view of the drag-enhancing structure of FIG. 7 taken along line 8-8 of FIG. 7.

FIG. 7 is a schematic representation of a drag-enhancing structure 200 according to the present discourse that includes a plurality of symmetrical, or at least substantially symmetrical, fins, while FIG. 8 is a transverse cross-sectional view of the drag-enhancing structure of FIG. 7 taken along line 8-8 in FIG. 7. The drag-enhancing structure of FIGS. 7-8 includes a plurality of tapered fins 234 that may include transition region 272 on an outer end thereof and that define a plurality of channels 220 therebetween.

As illustrated in FIG. 8, channels 220 may be sized and/or oriented to provide for (i.e. permit) flow of sealing materials 90 therethrough. In addition, FIG. 8 also illustrates that, as discussed in more detail herein with reference to FIG. 3, drag-enhancing structure 200 may define a maximum 204 transverse dimension 202, as well as a minimum 206 transverse dimension 202.

Figure 9:
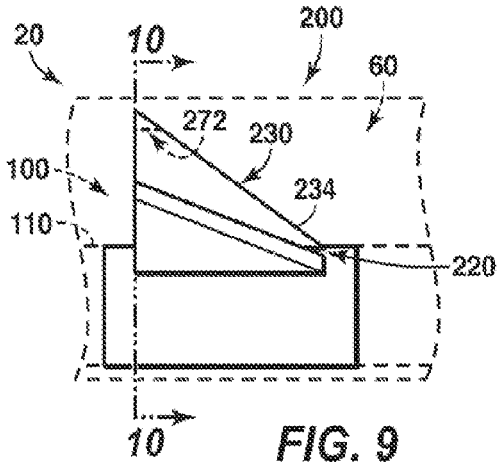
FIG. 9 is another less schematic but still illustrative, non-exclusive example of a drag-enhancing structure according to the present disclosure that includes a plurality of asymmetrical fins.
Figure 10:
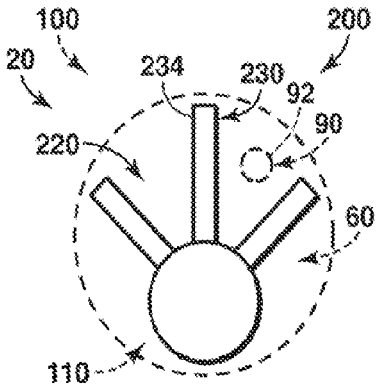
FIG. 10 is a transverse cross-sectional view of the drag-enhancing structure of FIG. 9 taken along line 10-10 of FIG. 9.

FIG. 9 is a schematic representation of a drag-enhancing structure 200 according to the present disclosure that includes a plurality of asymmetrical protrusions 230, while FIG. 10 is a transverse cross-sectional view of the drag-enhancing structure of FIG. 9 taken along line 10-10 in FIG. 9. The drag-enhancing structure of FIGS. 9-10 includes a plurality of asymmetrical tapered fins 234 that also may include transition region 272 on an outer edge thereof and define a plurality of channels 220 therebetween. Similar to FIGS. 7-8, channels 220 may be sized to provide for flow of sealing materials 90 therethrough.

Figure 11:
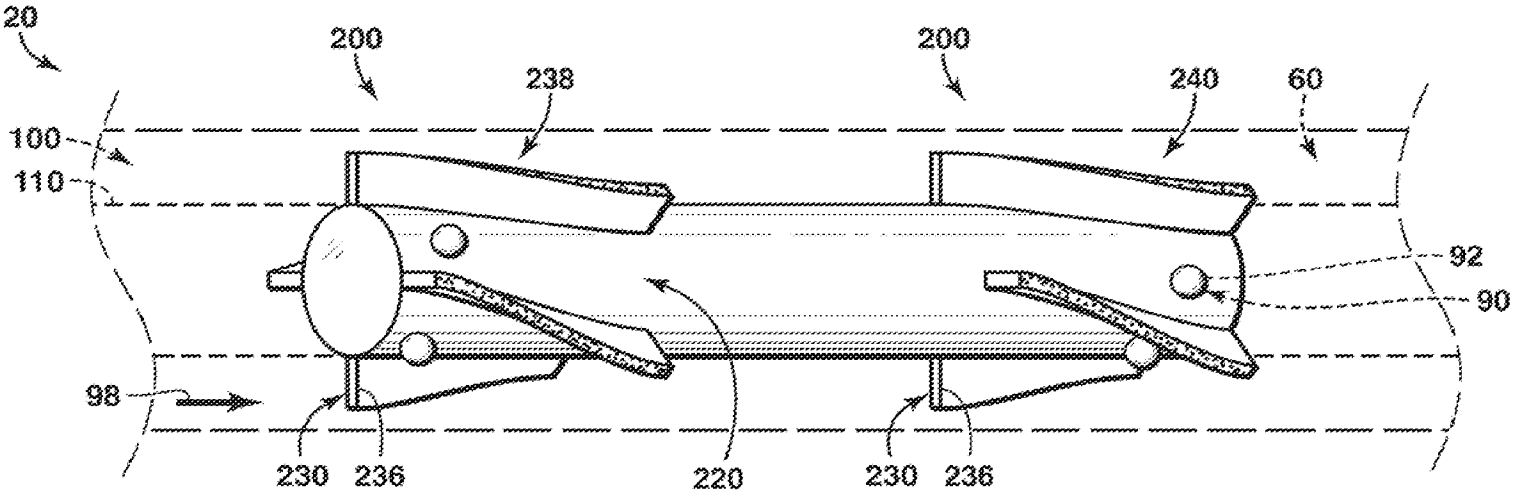
FIG. 11 is another less schematic but still illustrative, non-exclusive example of a drag-enhancing structure according to the present disclosure that includes a first plurality of helical fins and a second plurality of opposed helical fins.

FIG. 11 is another less schematic but still illustrative, non-exclusive example of a drag-enhancing structure 200 according to the present disclosure that includes a first plurality 238 of helical fins 236 and a second plurality 240 of helical fins 236 that define a plurality of channels 220. As discussed, the plurality of channels provide for flow of fluid, proppant, and/or sealing materials 90, such as ball sealers 92, therethrough.

As illustrated in FIG. 11, a direction, helical direction, twist direction, and/or rotational direction of first plurality 238 of helical fins 236 may be opposed to the rotational direction of the second plurality 240 of helical fins 236. This opposed rotational direction of the two pluralities of helical fins 236 may decrease a magnitude of and/or potential for torsional forces that may be applied to downhole assembly 100 due to the flow of fluid 98 therepast when the downhole assembly is present within wellbore conduit 60.

As illustrated in FIG. 11, first plurality 238 and second plurality of 240 may be spaced-apart along the length of downhole assembly 100. However, it is within the scope of the present disclosure that first plurality 238 may not be spaced apart from second plurality 240 and/or that first plurality 238 and second plurality 240 may define a plurality of continuous channels 220. Alternatively, it is also within the scope of the present disclosure that downhole assembly 100 may include one of first plurality 238 and second plurality 240 but not the other of first plurality 238 and second plurality 240.

Figure 12:
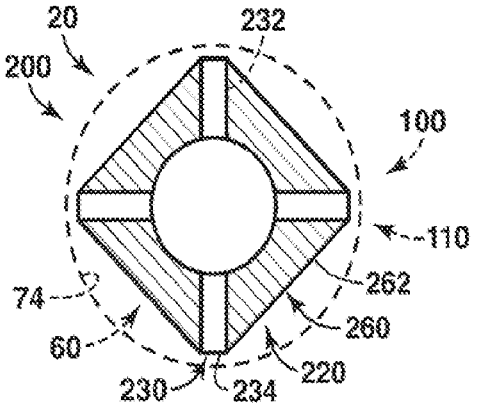
FIG. 12 is a transverse cross-sectional view of another less schematic but still illustrative, non-exclusive example of a drag-enhancing structure according to the present disclosure that includes a resilient cape, wherein the resilient cape is in an undeformed configuration.
Figure 13:
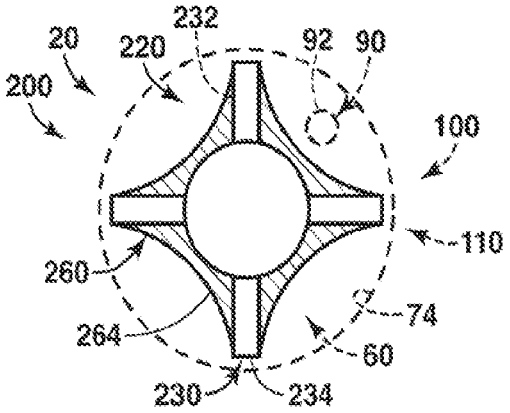
FIG. 13 is a transverse cross-sectional view of the drag-enhancing structure of FIG. 12, wherein the resilient cape is in a deformed configuration.

FIGS. 12-13 provide transverse cross-sectional views of another less schematic but still illustrative, non-exclusive example of a drag-enhancing structure 200 according to the present disclosure that includes a resilient cape 260. In FIG. 12, resilient cape 260 is in an undeformed configuration 262, while FIG. 13 illustrates resilient cape 260 in a deformed configuration 264. Undeformed configuration 262 additionally or alternatively may be referred to as an expanded and/or increased resistance configuration, and deformed configuration additionally or alternatively may be referred to as a contracted and/or decreased resistance configuration.

Cape 260 may extend around at least a portion of the plurality of protrusions 230 of drag-enhancing structure 200, thereby increasing a resistance to fluid flow therepast. Cape 260 may be constructed and/or formed from a resilient material and/or an elastomeric material. Additionally or alternatively, protrusions 230 may include and/or be retractable protrusions 232, as discussed in more detail herein with reference to FIG. 14.

Thus, and as a flow rate of fluid past downhole assembly 100 increases, a force that is applied to cape 260 may increase, thereby deforming the cape and increasing a size of channels 220 that are present between cape 260 and surface 74. This may provide for flow of sealing materials 90 past drag-enhancing structure 200 under certain flow conditions (i.e., relatively higher flow rates) but limit and/or block flow of sealing materials 90 past the drag-enhancing structure under other flow conditions (i.e., relatively lower flow rates). Additionally or alternatively, this may provide for an increase in a cross-sectional area of channels 220 responsive to an increase in a flow rate of fluid past the downhole assembly and/or a decrease in the cross-sectional area of channels 220 responsive to a decrease in the flow rate of fluid past the downhole assembly.

The presence of cape 260 on drag-enhancing structure 200 may focus fluid flow through channels 220 in a region of wellbore conduit 60 that is proximal to surface 74. This may provide for improved cleaning of the wellbore conduit by flushing solid particulate, such as proppant materials, that may accumulate near surface 74 in the downhole direction with the fluid flow that passes downhole assembly 100.

Cape 260 is illustrated in FIGS. 12-13 as being present on a drag-enhancing structure 200 that includes four protrusions 230. However, it is within the scope of the present disclosure that cape 260 may be included on any suitable drag-enhancing structure 200 that includes any suitable number and/or shape of protrusions 230, including fewer or a greater number of protrusions than are illustrated in FIGS. 12 and 13. This may include any of the drag-enhancing structures that are illustrated in any of FIGS. 7-11.

It is within the scope of the present disclosure that protrusions 230 may include and/or be fixed protrusions that do not move with respect to a remainder of drag-enhancing structure 200. However, and as illustrated in FIG. 14, it is also within the scope of the present disclosure that protrusions 230 may include and/or be retractable protrusions 232, which also may be referred to herein as retractable fins 232, that are configured to retract into drag-enhancing structure 200.

Figure 14:
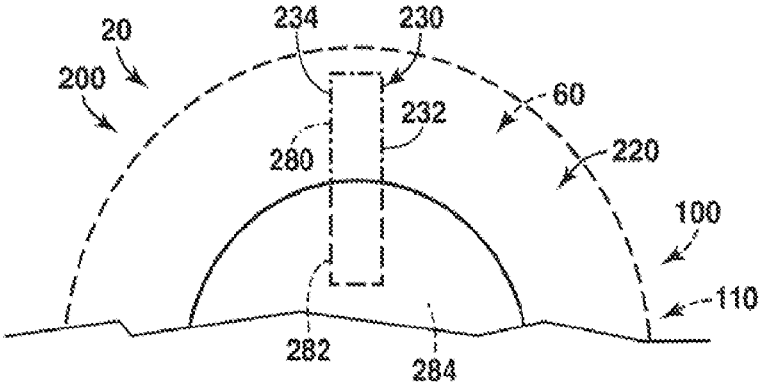
FIG. 14 is a fragmentary transverse cross-sectional view of an illustrative, non-exclusive example of a drag-enhancing structure according to the present disclosure that includes a retractable protrusion.

As illustrated in dash-dot-dot lines in FIG. 14, retractable protrusions 232 may include an expanded configuration 280, wherein the retractable protrusions extend outward of the maximum transverse perimeter of the tool string. In addition, and as illustrated in dashed lines in FIG. 14, retractable protrusions 232 also may include a retracted configuration 282, wherein the protrusion is at least partially, and optionally completely, retracted into drag-enhancing structure 200.

It is within the scope of the present disclosure that retractable protrusions 232 may transition between the expanded configuration and the retracted configuration based upon any suitable criteria and/or via any suitable mechanism and/or responsive to any suitable activating force. As illustrative, non-exclusive examples, retractable protrusions 232 may be configured to transition from the expanded configuration to the retracted configuration responsive to a pressure drop across the retractable protrusions exceeding a threshold pressure drop, a flow rate of fluid past the retractable protrusions exceeding a threshold flow rate, and/or actuation of a retraction device.

When drag-enhancing structure 200 includes retractable protrusions 232, the drag-enhancing structure also may include a biasing mechanism 284 that is configured to urge the retractable protrusions to one of the expanded configuration and the retracted configuration. As an illustrative, non-exclusive example, biasing mechanism 284 may urge retractable protrusions 232 to the expanded configuration. As another illustrative, non-exclusive example, retractable protrusions 232 may be configured to transition from the expanded configuration to the contracted configuration responsive to a force that is applied to the retractable protrusions by a fluid flow therepast exceeding a force that is applied to the retractable protrusions by biasing mechanism 284. Illustrative, non-exclusive examples of biasing mechanisms 284 include any suitable spring, resilient material, electrical latch, hydraulic latch, pneumatic latch, and/or mechanical latch.

Figure 15:
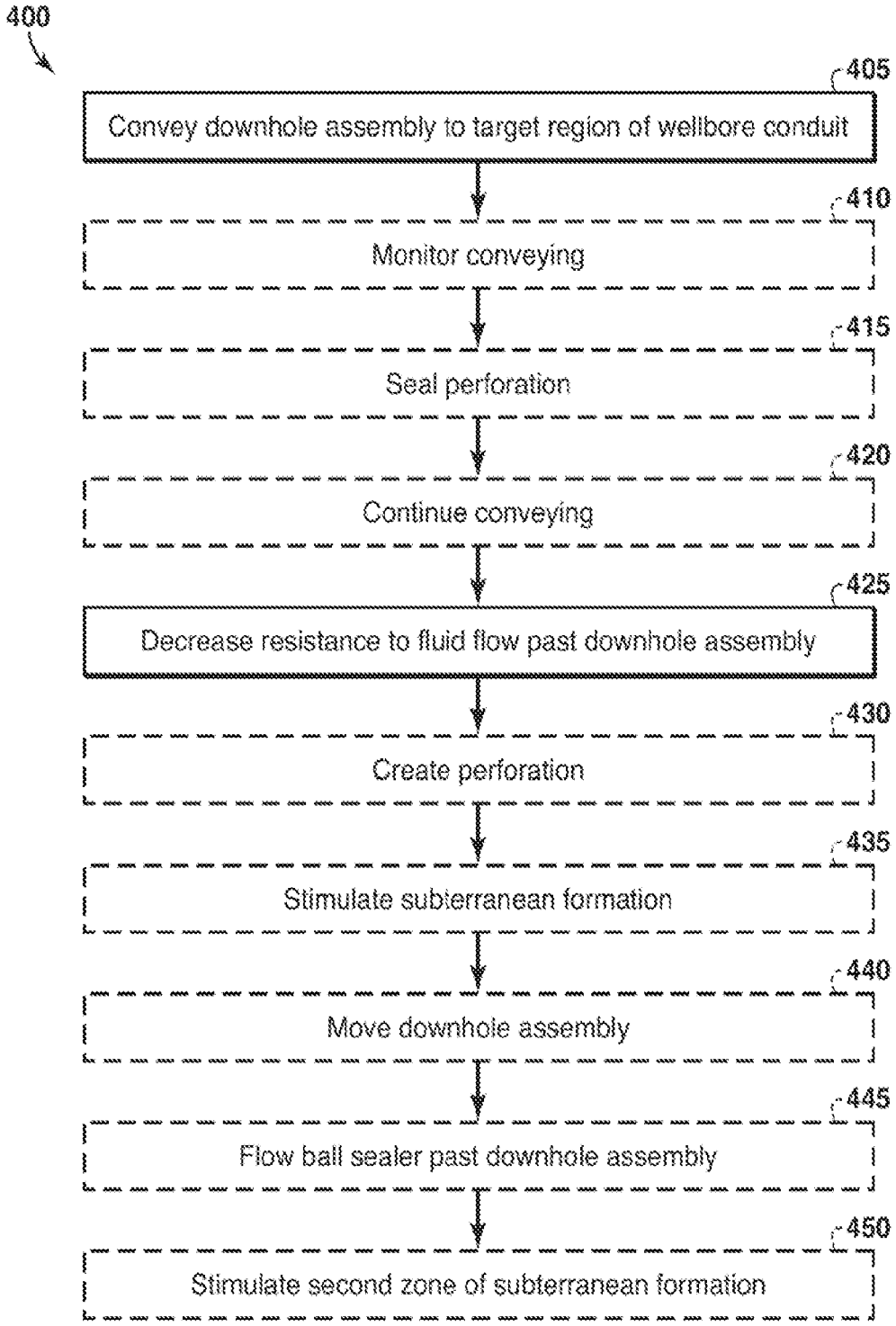
FIG. 15 is a flowchart depicting methods according to the present disclosure of positioning a downhole assembly within a wellbore conduit.
Figure 16:
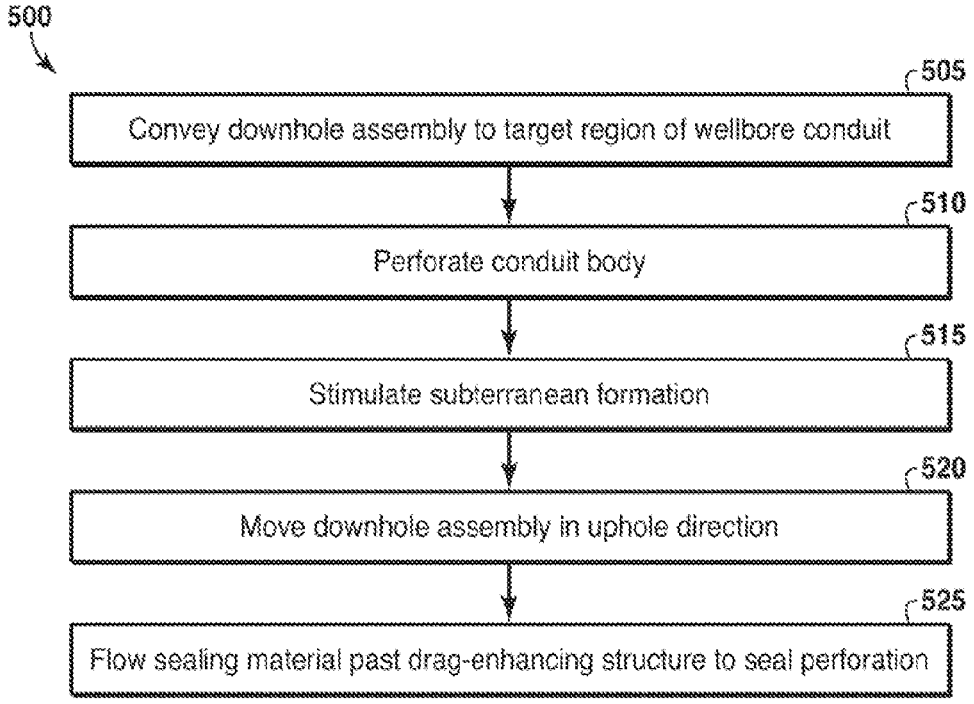
FIG. 16 is a flowchart depicting methods according to the present disclosure of stimulating a target zone of a subterranean formation.

FIGS. 15-16 provide illustrative, non-exclusive examples of methods according to the present disclosure. Steps that are generally included in a given method are illustrated in solid lines in FIGS. 15-16, while steps that are optional to a given method are illustrated in dashed lines. However, steps that are included in solid lines are not required of all embodiments, and other steps may be added to a given method without departing from the scope of the present disclosure.

It is within the scope of the present disclosure that the methods of FIGS. 15-16 may be performed using any suitable system, apparatus, and/or structure. However, and as illustrative, non-exclusive examples, the methods of FIGS. 15-16 are introduced herein with reference to the structures of FIGS. 1-14.

With this in mind, FIG. 15 is directed to methods 400 according to the present disclosure of positioning a downhole assembly within a wellbore conduit. The downhole assembly of FIG. 15 may include a drag-enhancing structure that is configured to aid in conveying the downhole assembly in a downhole direction within the wellbore conduit and that, subsequent to the conveying, is configured to be actuated to decrease a resistance to fluid flow therepast. As discussed with reference to FIGS. 1-14, this actuation may be accomplished in a variety of ways, illustrative, non-exclusive examples of which include separating the drag-enhancing structure from the downhole assembly and/or from a tool string thereof, destroying the drag-enhancing structure while the downhole assembly is located within the wellbore conduit, retracting a portion of the drag-enhancing structure into the downhole assembly, and/or deforming a portion of the drag-enhancing structure. Regardless of the specific mechanism that may be utilized, a geometry of the downhole assembly of FIG. 15 is at least temporarily changed subsequent to the actuation, thereby providing for the decrease in resistance to fluid flow therepast.

In contrast, FIG. 16 is directed to methods 500 according to the present disclosure of stimulating a target zone of a subterranean formation. The methods of FIG. 16 may include the use of a downhole assembly that includes a drag-enhancing structure that includes one or more passages and/or channels that are configured to provide for flow of a sealing material, such as a ball sealer, therepast while the downhole assembly is present within the wellbore conduit, as discussed in more detail herein with reference to FIGS. 1-3 and 7-13.

FIG. 15 is a flowchart depicting methods 400 according to the present disclosure of positioning a downhole assembly within a wellbore conduit. Methods 400 include conveying the downhole assembly to a target region of the wellbore conduit at 405 and decreasing a resistance to fluid flow past the downhole assembly at 425. Methods 400 also may include monitoring the conveying at 410, sealing a perforation at 415, continuing the conveying at 420, creating a perforation at 430, stimulating a subterranean formation at 435, moving the downhole assembly within the wellbore conduit at 440, flowing a ball sealer past the downhole assembly at 445, and/or stimulating a second zone of the subterranean formation at 450.

Conveying the downhole assembly to the target region of the wellbore conduit at 405 may include conveying the downhole assembly with a fluid, such as a liquid. As an illustrative, non-exclusive example, the conveying may include supplying the fluid to and/or through the wellbore conduit and flowing the downhole assembly through the wellbore conduit with the fluid. As another illustrative, non-exclusive example, the conveying may include producing a pressure differential across the downhole assembly, wherein the pressure differential may provide a motive force that urges, or conveys, the downhole assembly in the downhole direction within the wellbore conduit.

The target region of the wellbore conduit may include any suitable region and/or portion of the wellbore conduit. As an illustrative, non-exclusive example, the target region of the wellbore conduit may include a portion of the wellbore conduit that is located within a subterranean formation that may include and/or contain a reservoir fluid, such as a hydrocarbon, oil, and/or natural gas. As another illustrative, non-exclusive example, the target region of the wellbore conduit may be located in, be proximal to, and/or be associated with a zone of the subterranean formation that is to be stimulated, with the downhole assembly being utilized to perform, provide for, and/or permit at least a portion of a stimulation process.

As yet another illustrative, non-exclusive example, the target region of the wellbore conduit may include any suitable orientation, including a vertical portion of the wellbore conduit, a deviated portion of the wellbore conduit, and/or a horizontal portion of the wellbore conduit. It is within the scope of the present disclosure that the wellbore conduit may extend between a surface region and the subterranean formation, and the target region of the wellbore conduit may be located at any suitable distance from the surface region as measured along a length of the wellbore conduit. As illustrative, non-exclusive examples, the target region of the wellbore conduit may be at least 1000 meters (m), at least 2000 m, at least 3000 m, at least 4000 m, at least 5000 m, at least 6000 m, at least 7000 m, at least 8000 m, at least 9000 m, or at least 10,000 m from the surface region, as measured along the length of the wellbore conduit.

Monitoring the conveying at 410 may include monitoring any suitable process, variable, and/or component that may be indicative of and/or related to a motion and/or location of the downhole assembly within the wellbore conduit. As an illustrative, non-exclusive example, the monitoring may include monitoring the motion of the downhole assembly, such as through the use of a casing collar locator, use of a wireless or wired transmission device associated with a corresponding motion, position, and/or depth sensor and/or by monitoring a length of a working line that extends between the surface region and the downhole assembly.

Regardless of the specific mechanism that may be utilized to monitor the conveying, it is within the scope of the present disclosure that the decreasing the resistance at 425 may be performed based, at least in part, on the monitoring. As an illustrative, non-exclusive example, the decreasing may be performed responsive to determining and/or detecting that the downhole assembly is within the target region of the wellbore conduit.

As another illustrative, non-exclusive example, the decreasing may be performed responsive to determining and/or detecting that the motion of the downhole assembly is less than a threshold value and/or that the downhole assembly is stuck and/or otherwise lodged within the wellbore conduit. Thus, it is within the scope of the present disclosure that the decreasing at 425 may be utilized to free a downhole assembly that might otherwise be stuck within the wellbore conduit, thereby providing for continued motion of the downhole assembly in the downhole direction and/or providing for retrieval of the downhole assembly to the surface region.

The wellbore conduit may be defined by a conduit body, such as a casing string and/or a liner, that extends within a wellbore and between the surface region and the subterranean formation. It is within the scope of the present disclosure that, prior to the conveying at 405, the conduit body may include one or more perforations that provide fluid communication between the wellbore conduit and the subterranean formation. Under these conditions, the downhole assembly may be readily conveyed within the wellbore conduit to the perforation. However, and subsequent to reaching and/or passing the perforation, a significant proportion of the fluid that is utilized to convey the downhole assembly within the wellbore conduit may be lost to the subterranean formation through the perforation, thereby decreasing a proportion of the supplied fluid that is available to convey the downhole assembly.

Thus, methods 400 may include conveying the downhole assembly past the perforation and subsequently sealing the perforation at 415, such as through the use of a sealing material and/or a ball sealer. This may provide for sealing the perforation without the need to flow the sealing material past the downhole assembly and/or without the need to flow the downhole assembly past a perforation that already includes an associated ball sealer, both of which may be difficult when a clearance between the drag-enhancing structure and the conduit body is less than a diameter of the ball sealer. Subsequent to sealing the perforation at 415, the fluid loss through the perforation may be decreased and/or eliminated, thereby providing for continued conveyance of the downhole assembly in the downhole direction, as indicated at 420.

Decreasing the resistance to fluid flow past the downhole assembly at 425 may include decreasing the resistance to fluid flow while the downhole assembly is present and/or located within the wellbore conduit. This may provide for, permit, and/or enable sealing materials, such as ball sealers, to flow past the downhole assembly, may provide for, permit, and/or enable more rapid and/or easier motion of the downhole assembly in an uphole direction within the wellbore conduit, and/or may decrease a pressure drop across the downhole assembly when the downhole assembly is present within the wellbore conduit, thereby simplifying pressure control within the wellbore conduit.

Additionally or alternatively, the decreasing also may decrease a tensile force that is applied to a working line that is attached to the downhole assembly due to fluid flow past the downhole assembly, thereby providing for increased fluid flow past the downhole assembly for a given tensile force. This may permit fluid flow rates that are sufficient to perform the stimulating at 435 without damage to the working line and/or the downhole assembly.

Decreasing the resistance at 425 may be accomplished in any suitable manner. As an illustrative, non-exclusive example, decreasing the resistance may include decreasing an outer dimension of the downhole assembly and/or increasing a clearance between the downhole assembly and a surface that defines the wellbore conduit. As another illustrative, non-exclusive example, decreasing the resistance at 425 may include decreasing the maximum transverse dimension and/or the maximum transverse cross-sectional area of the downhole assembly by at least a threshold amount, illustrative, non-exclusive examples of which include threshold amounts of at least 5%, at least 10%, at least 15%, at least 20%, at least 25%, at least 30%, at least 25%, at least 30%, at least 35%, at least 40%, at least 45%, or at least 40%.

As yet another illustrative, non-exclusive example, and as discussed herein, the downhole assembly may include a drag-enhancing structure that is operatively attached to and extends outward of a maximum transverse perimeter of a tool string, and decreasing the resistance at 425 may include decreasing and/or eliminating an extent to which the drag-enhancing structure, and/or a drag-enhancing structure body thereof, extends outward of the maximum transverse perimeter of the tool string. It is within the scope of the present disclosure that the decreasing at 425 may include reversibly decreasing the resistance to fluid flow past the downhole assembly, such as by retracting a portion of the drag-enhancing structure body into the downhole assembly.

However, it is also within the scope of the present disclosure that the decreasing at 425 may include irreversibly decreasing the resistance to fluid flow past the downhole assembly. As an illustrative, non-exclusive example, the decreasing at 425 may include releasing and/or separating the drag-enhancing structure body from the tool string.

As another illustrative, non-exclusive example, and as discussed, the drag-enhancing structure may include a frangible drag-enhancing structure body, and the decreasing may include destroying, shattering, and/or breaking apart the frangible drag-enhancing structure body. This may separate at least a portion of the drag-enhancing structure body from the downhole assembly.

It is within the scope of the present disclosure that the destroying, shattering, and/or breaking apart may be accomplished in any suitable manner, such as by actuating a release mechanism. As illustrative, non-exclusive examples, the actuating may include firing a perforation charge that is configured to pass through at least a portion of the drag-enhancing structure body and/or generate a shock wave that is sufficient to destroy the drag-enhancing structure body, exploding a suitable explosive charge and/or a primer cord in the vicinity of and/or within the drag-enhancing structure body, striking a portion of the drag-enhancing structure body, and/or deforming a portion of the drag-enhancing structure body. When the decreasing at 425 includes firing the perforation charge, it is within the scope of the present disclosure that, the perforation charge further may create one or more perforations within a conduit body that defines the wellbore conduit, such as is discussed in more detail herein with reference to creating the perforation at 430.

It is within the scope of the present disclosure that decreasing the resistance at 425 may be performed and/or accomplished without damage to and/or loss in functionality of the tool string. As illustrative, non-exclusive examples, methods 400 further may include maintaining an integrity of the tool string subsequent to the decreasing at 425, operating the tool string subsequent to the decreasing at 425, perforating the conduit body with the tool string subsequent to the decreasing at 425, and/or stimulating the subterranean formation subsequent to the decreasing at 425.

As another illustrative, non-exclusive example, methods 400 further may include reusing the tool string subsequent to the decreasing at 425. This may include removing the tool string from the wellbore conduit, attaching another drag-enhancing structure to the tool string, and reinserting the tool string into the wellbore conduit and/or into another wellbore conduit. As yet another illustrative, non-exclusive example, methods 400 further may include repeating at least the conveying at 405, and the decreasing the resistance at 425, in another target region of the wellbore conduit subsequent to reinserting the tool string into the wellbore conduit.

Creating a perforation at 430 may include creating any suitable number of perforations within a conduit body that defines the wellbore conduit using any suitable structure, illustrative, non-exclusive examples of which are discussed in more detail herein. It is within the scope of the present disclosure that the creating at 430 may include creating a single perforation and/or creating a plurality of perforations in a single region of the conduit body that is associated with the target region of the wellbore conduit. However, it is also within the scope of the present disclosure that, as discussed in more detail herein, the perforating may include creating a plurality of perforations in a plurality of regions of the conduit body that is associated with a plurality of target regions of the wellbore conduit, such as by moving the downhole assembly among the plurality of target regions of the wellbore conduit during the moving at 440 and repeating the creating at 430 in each of the plurality of target regions.

Stimulating the subterranean formation at 435 may include providing a stimulant fluid, such as a fracturing fluid, an acid, and/or a fluid that includes a proppant, through the one or more perforations that were formed during the creating the perforation at 430 and to the subterranean formation. This may include stimulating a single zone of the subterranean formation or, as discussed in more detail herein, stimulating a plurality of zones of the subterranean formation, either simultaneously or sequentially.

Moving the downhole assembly within the wellbore conduit at 440 may include the use of any suitable structure to move the downhole assembly. As an illustrative, non-exclusive example, the moving may include pulling the downhole assembly in an uphole direction with a working line that is attached thereto. As another illustrative, non-exclusive example, the moving may include moving the downhole assembly to a second, or subsequent, target region of the wellbore conduit that is associated with a second, or subsequent, zone of the subterranean formation.

Flowing ball sealers past the downhole assembly at 445 may include providing any suitable ball sealer to the wellbore conduit, providing the fluid to the wellbore conduit, and flowing the ball sealers with the fluid, in the downhole direction, and past the downhole assembly. As discussed in more detail herein, and prior to the decreasing at 425, a clearance between the downhole assembly and the surface that defines the wellbore conduit may be such that the ball sealers may not, or at least may not readily, flow past the downhole assembly. Thus, the flowing at 445 may be performed subsequent to the decreasing at 425, and the decreasing at 425 may provide for, permit, increase a potential for, and/or enable the flowing at 445 by increasing the clearance between the downhole assembly and the surface that defines the wellbore conduit.

Stimulating the second zone of the subterranean formation at 450 may include repeating any suitable portion of the method to accomplish the stimulating. As an illustrative, non-exclusive example, and subsequent to moving the downhole assembly to the second target region of the wellbore conduit, the stimulating at 450 may include creating a perforation in a portion of the conduit body that is associated with the second region of the wellbore conduit, as discussed in more detail herein with reference to the creating a perforation at 430, and providing a stimulant fluid to the second zone of the subterranean formation, as discussed in more detail herein with reference to the stimulating at 435.

The above discussion presents general methods 400, and any suitable step and/or series of steps of methods 400 may be performed in any suitable order and/or repeated any suitable number of times without departing from the scope of the present disclosure. With this in mind, the following embodiments represent more specific but still illustrative, non-exclusive examples of methods 400 according to the present disclosure.

In a first embodiment, the downhole assembly may include a tool string, which includes a perforation gun with a plurality of perforation charges, and a frangible drag-enhancing structure that is operatively attached thereto. Furthermore, the wellbore conduit is defined by a casing string that extends between a surface region and a subterranean formation. This embodiment may include conveying the downhole assembly to a first target region of the wellbore conduit that is associated with a first zone of the subterranean formation, as discussed herein with reference to the conveying at 405.

Subsequently, at least one perforation charge may be utilized to destroy the frangible drag-enhancing structure, thereby decreasing the resistance to fluid flow past the downhole assembly, as discussed herein with reference to the decreasing at 425. The at least one perforation charge also may create at least a first perforation within a first portion of the casing string that defines the first target zone of the wellbore conduit, as discussed herein with reference to creating the perforation at 430.

Subsequent to creation of the at least a first perforation, a stimulant fluid may be supplied through the at least a first perforation and to the first zone of the subterranean formation, as discussed herein with reference to the stimulating at 435. Then, the downhole assembly may be moved in an uphole direction and to a second target region of the wellbore conduit that is associated with a second zone of the subterranean formation, as discussed herein with reference to the moving at 440.

One or more sealing materials, such as ball sealers, may be flowed past the downhole assembly to seal the at least a first perforation, as discussed herein with reference to the flowing at 445, thereby providing for an increase in pressure within the wellbore conduit. As discussed, the frangible drag-enhancing structure may be sized such that the ball sealers may not, or may not readily, flow therepast. Thus, destruction of the frangible drag-enhancing structure may provide for, permit, and/or enable the flowing at 445.

After the pressure within the wellbore conduit reaches a threshold pressure, at least a second perforation charge may be utilized to create at least a second perforation in a second portion of the casing string that defines the second target portion of the wellbore conduit, as discussed herein with reference to the creating a perforation at 430. Thereafter, the stimulant fluid is provided through the at least a second perforation to the second zone of the subterranean formation, as discussed herein with reference to the stimulating at 435.

Subsequently, the downhole assembly may be moved in the uphole direction, as discussed in more detail herein with reference to the moving at 440; and a least a second ball sealer may be flowed past the downhole assembly to seal the at least a second perforation, as discussed herein with reference to the flowing at 445. This process may be repeated any suitable number of times, thereby stimulating any suitable number of zones of the subterranean formation.

In a second embodiment, the downhole assembly may include a tool string, which includes a perforation gun with a plurality of perforation charges, and a frangible drag-enhancing structure that is operatively attached thereto. Furthermore, the wellbore conduit is defined by a casing string that extends between a surface region and a subterranean formation. This embodiment may include conveying the downhole assembly to a first target region of the wellbore conduit of a plurality of target regions of the wellbore conduit that is associated with a first zone of the subterranean formation of a plurality of respective zones of the subterranean formation, as discussed herein with reference to the conveying at 405.

Subsequently, at least one perforation charge may be utilized to destroy the frangible drag-enhancing structure and create at least a first perforation in a first portion of the casing string that defines the first target region of the wellbore conduit, as discussed herein with reference to the creating a perforation at 430. The downhole assembly may then be moved in the uphole direction to a second target region of the wellbore conduit, as discussed herein with reference to the moving at 440, and at least a second perforation may be created in a second portion of the casing string that defines the second target region of the wellbore conduit. This process may be repeated until at least one perforation has been created in each portion of the casing conduit that is associated with each target region of the plurality of target regions of the wellbore conduit.

After formation of the perforations, stimulant fluid, such as a fracturing fluid, an acid, and/or a fluid that includes a proppant, may be provided to the wellbore conduit and may then flow through each perforation that has been created in the casing string, thereby stimulating the plurality of zones of the subterranean formation. In this embodiment, decreasing the resistance to fluid flow past the downhole assembly at 425 may provide for, permit, and/or enable stimulant fluid flow rates that are high enough to stimulate the plurality of zones of the subterranean formation without removal of the downhole assembly from the subterranean formation (i.e., the stimulant fluid may flow within the wellbore conduit and past the downhole assembly before reaching at least a portion of the perforations).

FIG. 16 is a flowchart depicting methods 500 according to the present disclosure of stimulating a target zone of a subterranean formation. Methods 500 include conveying a downhole assembly to a target region of a wellbore conduit at 505, perforating a conduit body that defines the wellbore conduit at 510 to create a perforation, stimulating a subterranean formation at 515, moving the downhole assembly at 520, and flowing a sealing material past the drag-enhancing structure to seal the perforation at 525.

The downhole assembly utilized in methods 500 may include a tool string and a drag-enhancing structure that is configured to increase a resistance to fluid flow past the downhole assembly when the downhole assembly is present within the wellbore conduit. The drag-enhancing structure may include a drag-enhancing structure body that extends past an outer perimeter of the tool string in a radial direction, and a minimum clearance between the drag-enhancing structure body and the conduit body may be less than a diameter of a ball sealer that is configured to seal a perforation within the conduit body. However, the conduit body may include a passage, or channel, which is sized to permit the ball sealer to flow therethrough and past the drag-enhancing structure while the downhole assembly is present within the wellbore conduit.

Conveying the downhole assembly at 505 may include conveying the downhole assembly in a downhole direction within the wellbore conduit with a fluid, and may be substantially similar to the conveying at 405, which is discussed in more detail herein. Perforating the conduit body at 510 may include perforating the conduit body with a perforation device and may be substantially similar to the creating a perforation at 430, which is discussed in more detail herein.

Stimulating the target zone of the subterranean formation at 515 may include providing a stimulant fluid, such as a fracturing fluid, an acid, and/or a fluid that includes a proppant, through the perforation that was created during the perforating at 510 and may be substantially similar to the stimulating at 435, which is discussed in more detail herein. Moving the downhole assembly at 520 may include moving the downhole assembly in an uphole direction such that the drag-enhancing structure is uphole from the perforation and may be substantially similar to the moving at 440, which is discussed in more detail herein.

Flowing the ball sealer past the drag-enhancing structure to seal the perforation may include flowing the ball sealer through the wellbore conduit and through the passage in the drag-enhancing structure to reach the perforation. As discussed in more detail herein, the minimum clearance between the drag-enhancing structure and the conduit body may be less than a diameter of the ball sealer. As such, the ball sealer would not readily flow past a drag-enhancing structure that does not include the passage therein. Therefore, the passage provides for, permits, and/or enables flow of the ball sealer past the drag-enhancing structure while the drag-enhancing structure is present within the wellbore conduit.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

INDUSTRIAL APPLICABILITY

The systems and methods disclosed herein are applicable to the oil and gas industry. It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

The invention claimed is:

1. A downhole assembly configured to be pumped within a wellbore conduit, the downhole assembly comprising:

a tool string that defines a maximum transverse perimeter;

a drag-enhancing structure with a frangible drag-enhancing structure body that is operatively attached to the tool string, extends outward of the maximum transverse perimeter of the tool string, and is configured to be destroyed while the downhole assembly is within the wellbore conduit;

a release mechanism configured to selectively initiate destruction of the drag-enhancing structure body;

wherein a transverse outer perimeter of the drag-enhancing structure body defines an included body area that is defined at a location of maximum value along a length of the drag-enhancing structure body, wherein the maximum transverse perimeter of the tool string defines an included tool string area that is defined at a location of maximum value along a length of the tool string, and further wherein the included body area is at least 1.2 times greater than the included tool string area.

2. The downhole assembly of claim 1, wherein the drag-enhancing structure body includes a plurality of fins that are present around a circumference of the drag-enhancing structure body.

3. The downhole assembly of claim 1, wherein the drag-enhancing structure is not a plug, a wiper plug, or a pig.

4. The downhole assembly of claim 1, wherein the release mechanism includes at least one of a perforation charge of a perforation device that forms a portion of the tool string, an explosive charge, a primer cord, a mechanical device, and a hydraulic device.

5. The downhole assembly of claim 1, wherein the release mechanism is configured to selectively initiate destruction of the drag-enhancing structure body while the drag-enhancing structure body is operatively attached to the tool string and without at least one of destroying the tool string and rendering the tool string inoperative.

6. The downhole assembly of claim 1, wherein at least a majority of the tool string is not frangible.

7. The downhole assembly of claim 1, wherein the tool string includes at least one of a perforation device, a perforation gun, a sealing apparatus, and a casing collar locator.

8. A hydrocarbon well, including a wellbore; and the downhole assembly of claim 1.

9. The hydrocarbon well of claim 8, wherein the wellbore conduit is defined within the wellbore that extends between a surface region and a subterranean formation, and further wherein the subterranean formation includes a reservoir fluid that includes at least one of a hydrocarbon, oil, and natural gas.

10. The hydrocarbon well of claim 8, wherein at least a portion of the wellbore conduit is at least one of horizontal and deviated.

11. The hydrocarbon well of claim 8, wherein the downhole assembly and the wellbore conduit define a first unoccluded cross-sectional area when the drag-enhancing structure is operatively attached to the tool string, wherein the tool string and the wellbore conduit define a second unoccluded cross-sectional area when the drag-enhancing structure is not operatively attached to the tool string, and further wherein the second unoccluded cross-sectional area is at least 20% greater than the first unoccluded cross-sectional area.

12. A method of positioning a downhole assembly within a wellbore conduit, the method comprising:

conveying, with a fluid, the downhole assembly in a downhole direction and to a target region of the wellbore conduit, wherein the downhole assembly includes a tool string and a drag-enhancing structure that includes a frangible drag-enhancing structure body; and decreasing a resistance to fluid flow past the downhole assembly while the downhole assembly is within the target region of the wellbore conduit by destroying the frangible drag-enhancing structure body.

13. The method of claim 12, wherein the decreasing includes decreasing an outer dimension of the downhole assembly.

14. The method of claim 12, wherein the decreasing includes decreasing a maximum transverse cross-sectional area of the downhole assembly by at least 20%.

15. The method of claim 12, wherein, prior to the decreasing, the frangible drag-enhancing structure body extends outward of a maximum transverse perimeter of the tool string, and further wherein the decreasing includes decreasing an extent to which the frangible drag-enhancing structure body extends outward of the maximum transverse perimeter of the tool string.

16. The method of claim 12, wherein the destroying includes at least one of shattering and breaking apart the frangible drag-enhancing structure body.

17. The method of claim 12, wherein the destroying includes actuating a release mechanism, wherein the actuating includes at least one of firing a perforation charge, exploding an explosive charge, exploding a primer cord, pressurizing a portion of the frangible drag-enhancing structure body, striking a portion of the frangible drag-enhancing structure body, and deforming a portion of the frangible drag-enhancing structure body.

18. The method of claim 12, wherein the decreasing includes increasing a clearance between the downhole assembly and a surface that defines the wellbore conduit.

19. The method of claim 12, wherein, during the conveying, the method further includes determining that the downhole assembly is stuck within the wellbore conduit and performing the decreasing based, at least in part, on the determining.

20. The method of claim 12, wherein the wellbore conduit is defined within a conduit body that includes a perforation, wherein the conveying includes conveying the downhole assembly past the perforation, wherein the method further includes sealing the perforation subsequent to the conveying the downhole assembly past the perforation, and further wherein the method includes continuing the conveying subsequent to the sealing.

21. The method of claim 12, wherein the method further includes flowing a ball sealer past the downhole assembly subsequent to the decreasing, wherein the decreasing includes enabling the ball sealer to flow past the downhole assembly.

22. The method of claim 12, wherein the tool string includes a perforation gun with a perforation charge, and further wherein the decreasing includes firing the perforation charge to destroy the frangible drag-enhancing structure body and create a first perforation in the conduit body.

23. The method of claim 22, wherein the wellbore conduit extends between a surface region and a subterranean formation, and further wherein the method includes supplying a stimulant fluid through the first perforation and to a first zone of the subterranean formation that is associated with the target region of the wellbore conduit.

24. The method of claim 23, wherein the target region is a first target region of the wellbore conduit, and further wherein the method includes moving the downhole assembly in an uphole direction and to a second target region of the wellbore conduit.

25. The method of claim 24, wherein the method further includes sealing the first perforation by flowing a first ball sealer past the downhole assembly.

26. The method of claim 12, wherein the tool string includes a perforation gun with a plurality of perforation charges, wherein the target region of the wellbore conduit is a first target region of the wellbore conduit of a plurality of target regions of the wellbore conduit, wherein the wellbore conduit is defined by a conduit body that extends between a surface region and a subterranean formation, and further wherein the method includes firing a respective perforation charge of the plurality of perforation charges in each target region of the plurality of target regions to create a plurality of perforations in the conduit body.

27. The method of claim 26, wherein the subterranean formation includes a plurality of zones, wherein each of the plurality of zones is associated with a respective target region of the plurality of target regions of the wellbore conduit, and further wherein the method includes supplying a stimulant fluid through the plurality of perforations and to the plurality of zones of the subterranean formation subsequent to the decreasing.

28. The method of claim 12, wherein the method further includes operating the tool string subsequent to the decreasing.

29. The method of claim 12, wherein the wellbore conduit is defined within a conduit body, and further wherein the method includes perforating the conduit body with the downhole assembly subsequent to the decreasing.

30. The method of claim 12, wherein the wellbore conduit extends between a surface region and a subterranean formation, and further wherein the method includes stimulating the subterranean formation subsequent to the decreasing.

31. A downhole assembly configured to be pumped within a wellbore conduit, the downhole assembly comprising:

a tool string that defines a maximum transverse perimeter; and a drag-enhancing structure that is operatively attached to the tool string, and includes a drag-enhancing structure body that extends outward of the maximum transverse perimeter of the tool string, wherein the drag-enhancing structure body includes a plurality of fins that define a plurality of channels, wherein each of the plurality of channels is sized to permit a ball sealer to flow past the drag-enhancing structure body while the downhole assembly is within the wellbore conduit;

wherein the drag-enhancing structure body is a frangible drag-enhancing structure body that is configured to be destroyed while the downhole assembly is within the wellbore conduit, and further wherein the downhole assembly includes a release mechanism that is configured to selectively initiate destruction of the drag-enhancing structure body.

* * * * *